US010373440B2

(12) United States Patent
Basallo et al.

(10) Patent No.: US 10,373,440 B2
(45) Date of Patent: Aug. 6, 2019

(54) GAMING SYSTEM AND METHOD PROVIDING A BONUS OPPORTUNITY WHEN A DESIGNATED RELATIONSHIP EXISTS BETWEEN A PLURALITY OF RANDOMLY DETERMINED ELEMENTS

(71) Applicant: IGT, Las Vegas, NV (US)

(72) Inventors: Leandro Basallo, San Francisco, CA (US); Rachael A. Bristol, San Francisco, CA (US); Colin M. Ferris, San Francisco, CA (US); John Grime, Foster City, CA (US); Ana K. Rollins, Burlingame, CA (US); Timothy L. Isaacson, Hayward, CA (US); Mark C. Nicely, Daly City, CA (US); Dacotah A. Petermann-Turner, Oakland, CA (US); Alex Present, Berkeley, CA (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/880,819

(22) Filed: Jan. 26, 2018

(65) Prior Publication Data

US 2018/0151029 A1 May 31, 2018

Related U.S. Application Data

(63) Continuation of application No. 13/793,997, filed on Mar. 11, 2013, now Pat. No. 9,881,460.

(Continued)

(51) Int. Cl.
*G07F 17/32* (2006.01)

(52) U.S. Cl.
CPC ..... *G07F 17/3267* (2013.01)

(58) Field of Classification Search
CPC ..... G07F 17/34; G07F 17/3267; G07F 17/32; G07F 17/3244; G07F 17/3293
See application file for complete search history.

(56) References Cited

U.S. PATENT DOCUMENTS 1,527,929 A 2/1925 Simons
2,077,124 A 4/1937 Miller
(Continued)

FOREIGN PATENT DOCUMENTS

EP 2 19 305 4/1987
EP 3 75 190 6/1990
(Continued)

OTHER PUBLICATIONS

"Double Super Times Pay Poker," Brochure, IGT Copyright 2010, available at http://www.videopokerforcasinos.com/pdf/game_brochures/Double%20Super%20Times%20Pay%20brochure.pdf (2 pages).

(Continued)

*Primary Examiner* — James S. McClellan
*Assistant Examiner* — Kevin M Carter
(74) *Attorney, Agent, or Firm* — Neal, Gerber & Eisenberg LLP

(57) ABSTRACT

Various embodiments of the present disclosure are directed to a gaming system and method providing a bonus opportunity when a designated relationship exists between a plurality of randomly determined elements. The gaming system randomly generates a plurality of elements in association with a play of a secondary game. The gaming system determines whether a designated relationship exists between the randomly determined elements. If the designated relationship exists between the randomly determined elements, the gaming system determines a bonus opportunity associ- (Continued)

ated with the randomly determined elements and provides the bonus opportunity to a player.

19 Claims, 28 Drawing Sheets

Related U.S. Application Data

(60) Provisional application No. 61/685,962, filed on Mar. 28, 2012.

(56) References Cited

U.S. PATENT DOCUMENTS

| | | | |
|---|---|---|---|
| 3,633,915 | A | 1/1972 | Lippert |
| 3,819,186 | A | 6/1974 | Hinterstocker |
| 4,346,900 | A | 8/1982 | Lamlee |
| 4,448,419 | A | 5/1984 | Telnaes |
| 4,492,378 | A | 1/1985 | Williams |
| 4,508,353 | A | 4/1985 | Meyer et al. |
| 4,624,459 | A | 11/1986 | Kaufman et al. |
| 4,695,053 | A | 9/1987 | Vazquez et al. |
| 4,732,386 | A | 3/1988 | Rayfiel |
| 4,743,022 | A | 5/1988 | Wood |
| 4,775,155 | A | 10/1988 | Lees |
| 4,941,665 | A | 7/1990 | Klamer |
| 5,046,735 | A | 9/1991 | Hamano et al. |
| 5,046,736 | A | 9/1991 | Bridgeman et al. |
| 5,072,946 | A | 12/1991 | Miller et al. |
| 5,100,137 | A | 3/1992 | Fulton et al. |
| 5,167,413 | A | 12/1992 | Fulton et al. |
| 5,184,821 | A | 2/1993 | Korenek |
| 5,205,555 | A | 4/1993 | Hamano |
| 5,251,897 | A | 10/1993 | Fulton et al. |
| 5,255,915 | A | 10/1993 | Miller |
| 5,259,616 | A | 11/1993 | Bergmann |
| 5,280,915 | A | 1/1994 | Groussman et al. |
| 5,288,082 | A | 2/1994 | Marquez et al. |
| 5,294,120 | A | 3/1994 | Schultz |
| 5,324,041 | A | 6/1994 | Boylan et al. |
| 5,374,067 | A | 12/1994 | Jones et al. |
| 5,380,012 | A | 1/1995 | Jones et al. |
| 5,382,025 | A | 1/1995 | Sklansky et al. |
| 5,393,057 | A | 2/1995 | Marnell et al. |
| 5,411,257 | A | 5/1995 | Fulton et al. |
| 5,415,404 | A | 5/1995 | Joshi et al. |
| 5,423,539 | A | 6/1995 | Nagao |
| 5,437,451 | A | 8/1995 | Fulton et al. |
| 5,449,173 | A | 9/1995 | Thomas et al. |
| 5,456,465 | A | 10/1995 | Durham |
| 5,489,101 | A | 2/1996 | Moody et al. |
| 5,511,781 | A | 4/1996 | Wood et al. |
| 5,531,441 | A | 7/1996 | Dabrowski et al. |
| 5,531,448 | A | 7/1996 | Moody et al. |
| 5,536,016 | A | 7/1996 | Thompson |
| 5,540,442 | A | 7/1996 | Orselli et al. |
| 5,542,669 | A | 8/1996 | Charron et al. |
| 5,553,851 | A | 9/1996 | Malavazos et al. |
| 5,560,603 | A | 10/1996 | Seelig et al. |
| 5,564,701 | A | 10/1996 | Dettor et al. |
| 5,584,763 | A | 12/1996 | Kelly et al. |
| 5,607,162 | A | 3/1997 | Boylan et al. |
| 5,611,535 | A | 3/1997 | Tiberio |
| 5,636,838 | A | 6/1997 | Caro |
| 5,707,285 | A | 1/1998 | Place et al. |
| 5,718,631 | A | 2/1998 | Invencion et al. |
| 5,722,891 | A | 3/1998 | Inoue |
| 5,732,948 | A | 3/1998 | Yoseloff et al. |
| 5,732,950 | A | 3/1998 | Moody et al. |
| 5,743,798 | A | 4/1998 | Adams et al. |
| 5,755,440 | A | 5/1998 | Sher |
| 5,755,621 | A | 5/1998 | Marks et al. |
| 5,769,716 | A | 6/1998 | Saffari et al. |
| 5,772,509 | A | 6/1998 | Weiss et al. |
| 5,788,573 | A | 8/1998 | Baerlocher et al. |
| 5,816,916 | A | 10/1998 | Moody |
| 5,820,460 | A | 10/1998 | Fulton et al. |
| 5,823,873 | A | 10/1998 | Moody et al. |
| 5,823,874 | A | 10/1998 | Adams et al. |
| 5,833,536 | A | 11/1998 | Davids et al. |
| 5,848,932 | A | 12/1998 | Adams et al. |
| 5,851,148 | A | 12/1998 | Brune et al. |
| 5,853,325 | A | 12/1998 | Kadlic et al. |
| 5,863,041 | A | 1/1999 | Boylan et al. |
| 5,882,259 | A | 3/1999 | Holmes et al. |
| 5,882,261 | A | 3/1999 | Adams et al. |
| 5,902,184 | A | 5/1999 | Bennett et al. |
| 5,911,418 | A | 6/1999 | Adams et al. |
| 5,919,088 | A | 7/1999 | Weiss et al. |
| 5,919,091 | A | 7/1999 | Bell et al. |
| 5,935,002 | A | 8/1999 | Falciglia |
| 5,944,314 | A | 8/1999 | Stavinsky et al. |
| 5,947,820 | A | 9/1999 | Morro et al. |
| 5,947,821 | A | 9/1999 | Stone |
| 5,951,397 | A | 9/1999 | Dickinson |
| 5,954,335 | A | 9/1999 | Moody et al. |
| 5,957,774 | A | 9/1999 | Holmes et al. |
| 5,971,849 | A | 10/1999 | Falciglia et al. |
| 5,988,643 | A | 11/1999 | Awada et al. |
| 5,989,121 | A | 11/1999 | Sakamoto |
| 5,996,997 | A | 12/1999 | Kamille et al. |
| 6,004,205 | A | 12/1999 | Lauretta et al. |
| 6,004,207 | A | 12/1999 | Wilson et al. |
| 6,007,066 | A | 12/1999 | Moody et al. |
| 6,015,346 | A | 1/2000 | Bennett |
| 6,033,306 | A | 3/2000 | De Souza et al. |
| 6,033,307 | A | 3/2000 | Vancura et al. |
| 6,050,658 | A | 4/2000 | O'Sullivan et al. |
| 6,056,642 | A | 5/2000 | Bennett |
| 6,059,289 | A | 5/2000 | Vancura et al. |
| 6,059,658 | A | 5/2000 | Mangano et al. |
| 6,062,979 | A | 5/2000 | Inoue |
| 6,089,976 | A | 7/2000 | Schneider et al. |
| 6,089,977 | A | 7/2000 | Bennett |
| 6,089,978 | A | 7/2000 | Adams |
| 6,093,101 | A | 7/2000 | Mourad |
| 6,098,985 | A | 8/2000 | Moody et al. |
| 6,102,798 | A | 8/2000 | Bennett |
| 6,105,962 | A | 8/2000 | Malavazos et al. |
| 6,110,040 | A | 8/2000 | Sanduski et al. |
| 6,113,098 | A | 9/2000 | Adams |
| 6,117,009 | A | 9/2000 | Yoseloff |
| 6,123,333 | A | 9/2000 | McGinnis, Sr. et al. |
| 6,126,542 | A | 10/2000 | Fier |
| 6,129,355 | A | 10/2000 | Hahn et al. |
| 6,131,907 | A | 10/2000 | Nucifora et al. |
| 6,132,311 | A | 10/2000 | Williams et al. |
| 6,135,883 | A | 10/2000 | Hachquet |
| 6,142,873 | A | 11/2000 | Weiss et al. |
| 6,146,271 | A | 11/2000 | Kadlic et al. |
| 6,149,521 | A | 11/2000 | Sanduski |
| 6,159,096 | A | 12/2000 | Yoseloff |
| 6,159,097 | A | 12/2000 | Gura et al. |
| 6,159,098 | A | 12/2000 | Slomiany et al. |
| 6,162,121 | A | 12/2000 | Morro et al. |
| 6,164,652 | A | 12/2000 | Lauretta et al. |
| 6,165,069 | A | 12/2000 | Sines et al. |
| 6,168,520 | B1 | 1/2001 | Baerlocher et al. |
| 6,173,955 | B1 | 1/2001 | Perrie et al. |
| 6,174,234 | B1 | 1/2001 | Seibert, Jr. et al. |
| 6,174,235 | B1 | 1/2001 | Walker et al. |
| 6,179,711 | B1 | 1/2001 | Yoseloff |
| 6,190,254 | B1 | 2/2001 | Bennett |
| 6,193,235 | B1 | 2/2001 | Vancura et al. |
| 6,196,918 | B1 | 3/2001 | Miers et al. |
| 6,203,429 | B1 | 3/2001 | Demar et al. |
| 6,206,374 | B1 | 3/2001 | Jones |
| 6,209,869 | B1 | 4/2001 | Mathews |
| 6,213,877 | B1 | 4/2001 | Walker et al. |
| 6,217,022 | B1 | 4/2001 | Astancha |
| 6,224,483 | B1 | 5/2001 | Mayeroff |
| 6,227,542 | B1 | 5/2001 | Cosmi |
| 6,227,969 | B1 | 5/2001 | Yoseloff |
| 6,227,971 | B1 | 5/2001 | Weiss |

(56) References Cited

U.S. PATENT DOCUMENTS

| | | | |
|---|---|---|---|
| 6,231,442 | B1 | 5/2001 | Mayeroff |
| 6,234,897 | B1 | 5/2001 | Frohm et al. |
| 6,238,288 | B1 | 5/2001 | Walker et al. |
| 6,248,016 | B1 | 6/2001 | Walker et al. |
| 6,257,979 | B1 | 7/2001 | Walker et al. |
| 6,261,177 | B1 | 7/2001 | Bennett |
| 6,270,412 | B1 | 8/2001 | Crawford et al. |
| 6,287,197 | B1 | 9/2001 | Dickinson et al. |
| 6,299,165 | B1 | 10/2001 | Nagano |
| 6,305,686 | B1 | 10/2001 | Perrie et al. |
| 6,309,300 | B1 | 10/2001 | Glavich |
| 6,312,334 | B1 | 11/2001 | Yoseloff |
| 6,315,663 | B1 | 11/2001 | Sakamoto |
| 6,315,666 | B1 | 11/2001 | Mastera et al. |
| 6,322,309 | B1 | 11/2001 | Thomas et al. |
| 6,328,649 | B1 | 12/2001 | Randall et al. |
| 6,331,143 | B1 | 12/2001 | Yoseloff |
| 6,334,613 | B1 | 1/2002 | Yoseloff |
| 6,334,814 | B1 | 1/2002 | Adams |
| 6,336,860 | B1 | 1/2002 | Webb |
| 6,336,863 | B1 | 1/2002 | Baerlocher et al. |
| 6,340,158 | B2 | 1/2002 | Pierce et al. |
| 6,346,043 | B1 | 2/2002 | Colin et al. |
| 6,347,996 | B1 | 2/2002 | Gilmore et al. |
| 6,354,593 | B1 | 3/2002 | Frommer et al. |
| 6,358,146 | B1 | 3/2002 | Adams |
| 6,358,147 | B1 | 3/2002 | Jaffe et al. |
| 6,364,767 | B1 | 4/2002 | Brossard et al. |
| 6,368,216 | B1 | 4/2002 | Hedrick et al. |
| 6,375,567 | B1 | 4/2002 | Acres |
| 6,386,973 | B1 | 5/2002 | Yoseloff |
| 6,394,902 | B1 | 5/2002 | Glavich et al. |
| 6,398,218 | B1 | 6/2002 | Vancura |
| 6,398,220 | B1 | 6/2002 | Inoue |
| 6,398,644 | B1 | 6/2002 | Perrie et al. |
| 6,406,369 | B1 | 6/2002 | Baerlocher et al. |
| 6,413,161 | B1 | 7/2002 | Baerlocher et al. |
| 6,416,408 | B2 | 7/2002 | Tracy et al. |
| 6,419,578 | B1 | 7/2002 | Moody et al. |
| 6,419,579 | B1 | 7/2002 | Bennett |
| 6,422,940 | B1 | 7/2002 | Walker et al. |
| 6,454,651 | B1 | 9/2002 | Yoseloff |
| 6,471,208 | B2 | 10/2002 | Yoseloff et al. |
| 6,474,645 | B2 | 11/2002 | Tarantino |
| 6,481,713 | B2 | 11/2002 | Perrie et al. |
| 6,517,074 | B1 | 2/2003 | Moody et al. |
| 6,533,273 | B2 | 3/2003 | Cole et al. |
| 6,554,703 | B1 | 4/2003 | Bussick et al. |
| 6,561,898 | B2 | 5/2003 | Moody |
| 6,561,902 | B1 | 5/2003 | Walker et al. |
| 6,561,904 | B2 | 5/2003 | Locke et al. |
| 6,568,680 | B1 | 5/2003 | Moody et al. |
| 6,569,015 | B1 | 5/2003 | Baerlocher et al. |
| 6,572,471 | B1 | 6/2003 | Bennett |
| 6,589,115 | B2 | 7/2003 | Walker et al. |
| 6,592,456 | B2 | 7/2003 | Walker et al. |
| 6,592,457 | B1 | 7/2003 | Frohm et al. |
| 6,605,000 | B2 | 8/2003 | Adams |
| 6,612,574 | B1 | 9/2003 | Cole et al. |
| 6,638,164 | B2 | 10/2003 | Randall et al. |
| 6,644,664 | B2 | 11/2003 | Muir et al. |
| 6,652,377 | B1 | 11/2003 | Moody |
| 6,659,863 | B2 | 12/2003 | Ashley et al. |
| 6,663,448 | B1 | 12/2003 | Davies et al. |
| 6,663,489 | B2 | 12/2003 | Baerlocher |
| 6,669,550 | B1 | 12/2003 | Baerlocher et al. |
| 6,672,959 | B2 | 1/2004 | Moody et al. |
| 6,692,355 | B2 | 2/2004 | Baerlocher et al. |
| 6,705,944 | B2 | 3/2004 | Luciano |
| 6,719,630 | B1 | 4/2004 | Seelig et al. |
| 6,729,961 | B1 | 5/2004 | Millerschone |
| 6,746,328 | B2 | 6/2004 | Cannon et al. |
| 6,749,500 | B1 | 6/2004 | Nelson et al. |
| 6,749,502 | B2 | 6/2004 | Baerlocher |
| 6,793,577 | B1 | 9/2004 | Wilkins et al. |
| 6,796,904 | B2 | 9/2004 | Yoseloff |
| 6,827,646 | B2 | 12/2004 | Adams |
| 6,837,788 | B2 | 1/2005 | Cannon |
| 6,855,052 | B2 | 2/2005 | Weiss et al. |
| 6,855,053 | B2 | 2/2005 | Baerlocher |
| 6,857,957 | B2 | 2/2005 | Marks et al. |
| D503,951 | S | 4/2005 | Karstens |
| 6,878,061 | B2 | 4/2005 | Baerlocher et al. |
| 6,890,255 | B2 | 5/2005 | Jarvis et al. |
| 6,929,952 | B2 | 8/2005 | Baerlocher |
| 6,939,229 | B2 | 9/2005 | McClintic |
| 6,955,356 | B2 | 10/2005 | Moody |
| 6,964,416 | B2 | 11/2005 | McClintic et al. |
| 6,964,418 | B2 | 11/2005 | Moody |
| D512,464 | S | 12/2005 | Karstens |
| D512,465 | S | 12/2005 | Karstens |
| 6,971,954 | B2 | 12/2005 | Randall |
| 6,988,731 | B2 | 1/2006 | Inoue |
| 6,991,538 | B2 | 1/2006 | Cannon |
| 6,994,624 | B2 | 2/2006 | Gold et al. |
| 7,004,835 | B2 | 2/2006 | Baerlocher |
| 7,040,983 | B2 | 5/2006 | Dolloff et al. |
| 7,056,192 | B2 | 6/2006 | Venigalla et al. |
| 7,056,209 | B2 | 6/2006 | Baerlocher et al. |
| 7,059,965 | B2 | 6/2006 | Jackson |
| 7,059,967 | B2 | 6/2006 | Baerlocher |
| 7,066,814 | B2 | 6/2006 | Glavich et al. |
| 7,128,646 | B2 | 10/2006 | Baerlocher et al. |
| 7,137,628 | B2 | 11/2006 | Moody |
| 7,144,321 | B2 | 12/2006 | Mayeroff |
| 7,156,397 | B2 | 1/2007 | Moody et al. |
| 7,179,169 | B2 | 2/2007 | Beaulieu et al. |
| 7,198,570 | B2 | 4/2007 | Rodgers et al. |
| 7,201,655 | B2 | 4/2007 | Walker et al. |
| 7,204,488 | B2 | 4/2007 | Ilievski |
| 7,210,997 | B2 | 5/2007 | Hughs-Bair et al. |
| 7,222,857 | B2 | 5/2007 | Moody |
| 7,222,858 | B2 | 5/2007 | Moody |
| 7,226,358 | B2 | 6/2007 | Miller et al. |
| 7,247,092 | B2 | 7/2007 | Jarvis |
| 7,250,001 | B2 | 7/2007 | Baerlocher et al. |
| 7,252,591 | B2 | 8/2007 | Van Asdale |
| 7,258,611 | B2 | 8/2007 | Bigelow, Jr. et al. |
| 7,294,055 | B2 | 11/2007 | Baerlocher et al. |
| 7,297,057 | B2 | 11/2007 | Gerrard et al. |
| 7,306,518 | B2 | 12/2007 | Hughs-Baird et al. |
| 7,306,520 | B2 | 12/2007 | Kaminkow et al. |
| 7,311,598 | B2 | 12/2007 | Kaminkow et al. |
| 7,311,604 | B2 | 12/2007 | Kaminkow et al. |
| 7,326,109 | B2 | 2/2008 | Baerlocher |
| 7,331,863 | B2 | 2/2008 | Baerlocher |
| 7,338,370 | B2 | 3/2008 | Oles et al. |
| 7,341,512 | B2 | 3/2008 | Dolloff et al. |
| 7,354,342 | B2 | 4/2008 | Paulsen et al. |
| 7,354,344 | B2 | 4/2008 | Paulsen et al. |
| 7,387,568 | B2 | 6/2008 | Millerschone |
| 7,390,258 | B2 | 6/2008 | Millerschone |
| 7,393,276 | B2 | 7/2008 | Millerschone |
| 7,399,226 | B2 | 7/2008 | Mishra |
| 7,404,762 | B2 | 7/2008 | Moody |
| 7,416,186 | B2 | 8/2008 | Walker et al. |
| 7,425,176 | B2 | 9/2008 | Nelson et al. |
| 7,425,177 | B2 | 9/2008 | Rodgers et al. |
| 7,427,236 | B2 | 9/2008 | Kaminkow et al. |
| 7,431,644 | B2 | 10/2008 | Moody |
| 7,431,649 | B2 | 10/2008 | Webb et al. |
| 7,442,123 | B2 | 10/2008 | Brill et al. |
| 7,448,948 | B2 | 11/2008 | Hughs-Baird et al. |
| 7,448,949 | B2 | 11/2008 | Kaminkow et al. |
| 7,476,542 | B2 | 1/2009 | Walker et al. |
| 7,488,247 | B2 | 2/2009 | Hughs-Baird et al. |
| 7,488,248 | B2 | 2/2009 | Hughs-Baird et al. |
| 7,488,249 | B2 | 2/2009 | Hughs-Baird et al. |
| 7,488,251 | B2 | 2/2009 | Kaminkow |
| 7,494,412 | B2 | 2/2009 | Baerlocher |
| 7,524,243 | B2 | 4/2009 | Bansemer et al. |
| 7,566,271 | B2 | 7/2009 | Hostetler et al. |
| 7,575,514 | B2 | 8/2009 | Cuddy et al. |
| 7,591,723 | B2 | 9/2009 | Cregan et al. |

(56) References Cited

U.S. PATENT DOCUMENTS 7,625,278 B2 12/2009 Paulsen et al.
7,658,672 B1 2/2010 Wolf et al.
7,666,092 B2 2/2010 Kaminkow et al.
7,666,093 B2 * 2/2010 Lafky ..... G07F 17/32 463/20
7,690,978 B2 4/2010 Webb et al.
7,708,628 B2 5/2010 Baerlocher
7,722,462 B2 5/2010 Mayeroff
7,731,584 B2 6/2010 Glavich et al.
7,748,714 B2 7/2010 Nicely et al.
7,749,059 B2 7/2010 Tarantino
7,771,267 B2 8/2010 Mayeroff
7,771,268 B2 8/2010 Mayeroff
7,771,270 B2 8/2010 Kaminkow et al.
7,780,520 B2 8/2010 Baerlocher
7,785,185 B2 8/2010 Webb et al.
7,785,188 B2 8/2010 Cannon
7,794,317 B2 9/2010 Kaminkow et al.
7,803,041 B2 9/2010 Gold et al.
7,806,760 B2 10/2010 Baerlocher
7,815,500 B2 10/2010 Montross et al.
7,837,545 B2 11/2010 Blair, Jr. et al.
7,837,560 B2 11/2010 Wiltshire et al.
7,850,171 B2 12/2010 Bontempo et al.
7,857,693 B1 12/2010 Johnson et al.
7,874,908 B2 1/2011 Walker et al.
7,896,734 B2 3/2011 Kaminkow et al.
7,922,571 B2 4/2011 Walker et al.
7,967,676 B2 6/2011 Rodgers et al.
7,993,191 B2 8/2011 Evans et al.
8,006,978 B2 8/2011 Bontempo et al.
8,100,754 B2 1/2012 Bigelow, Jr. et al.
8,353,762 B2 * 1/2013 Rodgers ..... G07F 17/3258 463/20
8,668,573 B1 * 3/2014 Mayeroff ..... G07F 17/3211 463/16
9,053,609 B2 6/2015 DeFrance et al.
2002/0022514 A1 2/2002 Randall
2002/0025847 A1 2/2002 Thomas et al.
2002/0034974 A1 3/2002 Wood et al.
2002/0077167 A1 6/2002 Merari
2002/0137559 A1 9/2002 Baerlocher
2003/0036420 A1 2/2003 Baerlocher et al.
2003/0045338 A1 3/2003 Dolloff et al.
2003/0064773 A1 4/2003 Baerlocher et al.
2003/0064805 A1 4/2003 Wells
2003/0078093 A1 4/2003 Simms et al.
2003/0195027 A1 10/2003 Baerlocher et al.
2004/0014517 A1 1/2004 Inoue
2004/0048645 A1 3/2004 Webb et al.
2004/0053660 A1 3/2004 Webb et al.
2004/0053665 A1 3/2004 Baerlocher
2004/0072619 A1 4/2004 Brosnan et al.
2004/0097282 A1 5/2004 Baerlocher et al.
2004/0248640 A1 12/2004 Kaminkow et al.
2005/0020341 A1 1/2005 Brosnan
2005/0026671 A1 2/2005 Baerlocher
2005/0026673 A1 2/2005 Paulsen et al.
2005/0037839 A1 2/2005 Yoseloff
2005/0054415 A1 3/2005 Kaminkow et al.
2005/0054421 A1 3/2005 Hughs-Baird et al.
2005/0059486 A1 3/2005 Kaminkow
2005/0075159 A1 4/2005 Kaminkow et al.
2005/0101383 A1 5/2005 Wells
2005/0119039 A1 6/2005 Berman et al.
2005/0148383 A1 7/2005 Mayeroff
2005/0202863 A1 9/2005 Macaulay
2005/0215307 A1 9/2005 Jarvis et al.
2006/0025195 A1 2/2006 Pennington et al.
2006/0030403 A1 2/2006 Lafky
2006/0040721 A1 2/2006 Cuddy et al.
2006/0046821 A1 3/2006 Kaminkow et al.
2006/0046822 A1 3/2006 Kaminkow et al.
2006/0046823 A1 3/2006 Kaminkow et al.
2006/0063584 A1 3/2006 Cregan
2006/0068875 A1 3/2006 Cregan et al.
2006/0073872 A1 4/2006 Jensen
2006/0073873 A1 4/2006 Rodgers et al.
2006/0121978 A1 * 6/2006 Hornik ..... G07F 17/32 463/20
2006/0131810 A1 6/2006 Nicely
2006/0135241 A1 6/2006 Wolf et al.
2006/0142077 A1 6/2006 Miles et al.
2006/0170155 A1 8/2006 Silverman
2006/0189364 A1 8/2006 Baerlocher
2006/0205465 A1 9/2006 Dolloff et al.
2006/0237905 A1 10/2006 Nicely et al.
2006/0246989 A1 11/2006 Glavich et al.
2006/0252485 A1 11/2006 Baerlocher
2007/0054721 A1 3/2007 Jackson
2007/0087811 A1 4/2007 Mayeroff
2007/0120320 A1 5/2007 Miltenberger et al.
2007/0135203 A1 6/2007 Nicely
2007/0135204 A1 6/2007 Nicely
2007/0149292 A1 6/2007 Kaminkow et al.
2007/0167208 A1 7/2007 Acres
2007/0167211 A1 7/2007 Rodgers et al.
2007/0218982 A1 9/2007 Baerlocher
2007/0281778 A1 12/2007 Bigelow et al.
2008/0020817 A1 1/2008 Kaminkow
2008/0020842 A1 1/2008 Kaminkow
2008/0051168 A1 2/2008 Kaminkow
2008/0064462 A1 3/2008 Gerrard et al.
2008/0070702 A1 3/2008 Kaminkow et al.
2008/0090643 A1 4/2008 Kaminkow et al.
2008/0090647 A1 4/2008 Kaminkow
2008/0102927 A1 5/2008 Mayeroff
2008/0111309 A1 5/2008 Nicely et al.
2008/0113704 A1 5/2008 Jackson
2008/0113760 A1 5/2008 Baerlocher
2008/0119257 A1 5/2008 Stern et al.
2008/0132325 A1 6/2008 Oles et al.
2008/0148542 A1 6/2008 Mayeroff
2008/0153584 A1 6/2008 Cuddy et al.
2008/0188278 A1 8/2008 Paulsen et al.
2008/0200238 A1 8/2008 Mishra
2008/0207299 A1 8/2008 Whitcher
2008/0214255 A1 9/2008 Jarvis et al.
2008/0254847 A1 10/2008 Millerschone
2008/0272541 A1 11/2008 Walker et al.
2009/0005144 A1 1/2009 Moody
2009/0069068 A1 3/2009 Cole et al.
2009/0104959 A1 4/2009 Caputo et al.
2009/0104962 A1 4/2009 Nicely et al.
2009/0111577 A1 4/2009 Mead
2009/0117959 A1 5/2009 Nicely
2009/0117993 A1 5/2009 Bigelow, Jr. et al.
2009/0121434 A1 5/2009 Baerlocher et al.
2009/0124316 A1 5/2009 Baerlocher et al.
2009/0124326 A1 5/2009 Caputo et al.
2009/0181743 A1 7/2009 Bansemer et al.
2009/0224478 A1 9/2009 Evans et al.
2009/0239635 A1 9/2009 Graham
2009/0253492 A1 10/2009 Caputo et al.
2010/0035676 A1 2/2010 Nicely et al.
2010/0093416 A1 * 4/2010 Seelig ..... G07F 17/32 463/16
2010/0120484 A1 5/2010 Caputo et al.
2010/0120500 A1 5/2010 Rodgers et al.
2010/0120514 A1 * 5/2010 Caputo ..... G07F 17/32 463/22
2010/0120524 A1 5/2010 Rodgers et al.
2010/0144415 A1 6/2010 Wolf et al.
2010/0197386 A1 8/2010 Lafky et al.
2010/0234095 A1 9/2010 Cole et al.
2011/0003625 A1 1/2011 Montross et al.
2011/0081963 A1 * 4/2011 Chongolnee ..... G07F 17/3258 463/27
2011/0118014 A1 * 5/2011 Mitchell ..... G07F 17/3202 463/30
2011/0212760 A1 9/2011 Rodgers et al.
2011/0218027 A1 9/2011 Manz et al.
2011/0218029 A1 9/2011 Rodgers et al.
2011/0223987 A1 9/2011 Rodgers et al.

(56) References Cited

U.S. PATENT DOCUMENTS

| | | | |
|---|---|---|---|
| 2011/0263308 | A1 | 10/2011 | Evans et al. |
| 2011/0275427 | A1 | 11/2011 | Filipour et al. |
| 2012/0040730 | A1 | 2/2012 | Stern et al. |
| 2012/0077581 | A1 | 3/2012 | Pawloski et al. |
| 2012/0108337 | A1 | 5/2012 | Kelly et al. |
| 2012/0178512 | A1 | 7/2012 | Jarvis et al. |
| 2012/0270622 | A1 | 10/2012 | Pawloski et al. |
| 2012/0302317 | A1 | 11/2012 | Caputo et al. |
| 2012/0322534 | A1 | 12/2012 | Belger et al. |
| 2012/0329543 | A1 | 12/2012 | Nicely et al. |
| 2013/0172064 | A1 | 7/2013 | Bansemer et al. |
| 2013/0196740 | A1 | 8/2013 | Lafky et al. |
| 2013/0196749 | A1 | 8/2013 | Caputo et al. |
| 2013/0217457 | A1 | 8/2013 | Jarvis et al. |
| 2013/0260855 | A1 | 10/2013 | Jackson |
| 2013/0260869 | A1 | 10/2013 | Basallo et al. |
| 2013/0310126 | A1 | 11/2013 | Daniels |
| 2013/0316790 | A1 | 11/2013 | Haag et al. |
| 2014/0011558 | A1 | 1/2014 | Pawloski et al. |
| 2014/0011570 | A1 | 1/2014 | Nicely et al. |
| 2014/0038687 | A1 | 2/2014 | Nicely |
| 2014/0073388 | A1 | 3/2014 | Montross et al. |
| 2014/0087798 | A1 | 3/2014 | Nicely et al. |
| 2014/0087801 | A1 | 3/2014 | Nicely et al. |
| 2014/0087860 | A1 | 3/2014 | Basallo et al. |

FOREIGN PATENT DOCUMENTS

| | | |
|---|---|---|
| EP | 0 945 837 | 9/1999 |
| GB | 2 170 938 | 8/1986 |
| GB | 2 333 880 | 8/1999 |
| WO | WO 97/32285 | 9/1997 |
| WO | WO 00/12186 | 3/2000 |
| WO | WO 2004/054670 | 7/2004 |
| WO | WO 2008/070055 | 6/2008 |

OTHER PUBLICATIONS

"Good Times Pay Poker," Brochure, IGT Copyright 2008, available at http://media.igt.com/marketing/PromotionalLiterature/GamePromoLit_13C0A-2EE64.pdf (2 pages).

"Twenty-Five Play Draw Poker with Super Times Pay Poker," Brochure, IGT Copyright 2012, available at http://media.igt.com/marketing/PromotionalLiterature/GamePromoLit_1D71B-16D4D.pdf (2 pages).

* cited by examiner 3.9x Average multiplier in bonus
14.0 Pulls per hit 5.7x Average multiplier in bonus
11.6 Pulls per hit

GAMING SYSTEM AND METHOD PROVIDING A BONUS OPPORTUNITY WHEN A DESIGNATED RELATIONSHIP EXISTS BETWEEN A PLURALITY OF RANDOMLY DETERMINED ELEMENTS

PRIORITY CLAIM

This application is a continuation application of, and claims priority to and the benefit of U.S. patent application Ser. No. 13/793,997, filed on Mar. 11, 2013, which is a non-provisional of, and claims priority to and the benefit of, U.S. Provisional Patent Application No. 61/685,962, filed on Mar. 28, 2012, the entire contents of all of which are incorporated herein by reference.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur.

For such known gaming systems, an amount of a wager placed on a primary game by a player may vary. For instance, a gaming system may enable a player to wager a minimum quantity of credits, such as one credit (e.g., one penny, nickel, dime, quarter, or dollar), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Certain known gaming systems provide a bonus opportunity, such as a play of a bonus or secondary game, upon an occurrence of a mystery triggering event. The mystery triggering event is not displayed to the player and, therefore, the player is unaware of the occurrence of the mystery triggering event, how often the mystery triggering event occurs, the different types of available bonus opportunities associated with the mystery triggering event, and the like. This lack of information about the mystery triggering event can frustrate some players who desire more transparency with respect to how and when a bonus opportunity is provided.

Accordingly, there is a continuing need to increase the level of excitement and enjoyment for certain players by providing new and different ways of providing such players with one or more bonus opportunities upon the occurrence of an explicitly displayed triggering event.

SUMMARY

Various embodiments of the present disclosure are directed to a gaming system and method providing a bonus opportunity when a designated relationship exists between a plurality of randomly determined elements.

In certain embodiments, the gaming system is configured to operate a primary wagering game and a secondary game, such as a secondary matching game. The secondary matching game includes a plurality of different elements or components. In certain embodiments, each of the elements or components is associated with one of a plurality of different characteristics or attributes. In operation of certain embodiments, upon an occurrence of a secondary matching game triggering event, the gaming system randomly determines or selects a plurality of the elements (and in certain embodiments displays such random determinations). In one such embodiment, the gaming system separately or individually randomly determines each of such plurality of the elements.

Following this random determination(s), the gaming system determines whether a designated or predefined relationship exists between the randomly determined elements. In one embodiment, the designated relationship exists when the randomly determined elements are each associated with a same one of the characteristics. In another embodiment, the designated relationship exists when the randomly determined elements are each associated with a characteristic from a same group of a plurality of the characteristics. In these embodiments, if the designated relationship exists between the randomly determined elements, the gaming system provides the player one of a plurality of different bonus opportunities, such as an increased award opportunity or at least one play of at least one bonus game, wherein certain of the bonus opportunities are more lucrative, valuable, or advantageous than others. In various embodiments, the gaming system determines which of the bonus opportunities to provide to the player based on the characteristic (or characteristic group) associated with the randomly determined elements having the designated relationship. It should thus be appreciated that the secondary matching game of the present disclosure is configured to provide a bonus opportunity based not only on the existence of a designated relationship between a plurality of randomly determined elements, but also on the specific randomly determined elements between which the designated relationship exists.

In various embodiments, the secondary matching game includes an element generator or selector associated with the plurality of elements. In one such embodiment, the element generator includes one or more wheels each having a plurality of colored sections. In this embodiment, the sections of the wheel(s) are associated with or otherwise represent the different elements or components, and the colors of the sections are associated with or otherwise represent the different characteristics or attributes. In operation of this embodiment, upon an occurrence of a secondary matching game triggering event, the gaming system spins the wheel(s) to randomly determine or select a plurality of the sections of the wheel(s) (i.e., the element generator randomly selects a plurality of the elements). In this embodiment, the gaming system determines whether the designated relationship exists between the randomly determined sections of the wheel(s) by determining whether the randomly determined sections of the wheel(s) are each associated with the same color (or each belong to the same group or set of colors).

In this embodiment, if the randomly determined sections of the wheel are each associated with the same color (or each belong to the same group or set of colors), the gaming system determines which of a plurality of different bonus opportunities to provide to the player based on the color (or the group or set of colors) of the sections having the designated relationship. That is, in these embodiments, each color (or each group or set of colors) is associated with one of the bonus opportunities, and the color (or group or set of colors) associated with the plurality of randomly generated sections having the designated relationship (i.e., sharing the same color or group or set of colors), determines which bonus opportunity to provide to the player. The gaming system then provides the player the determined bonus opportunity. For example, if the gaming system determines that the randomly determined sections of the wheel are each associated with the color orange, the gaming system determines and provides the player a first modifier (i.e., a bonus opportunity) that is associated with the color orange for a play of the primary game. Further, in this example, if the gaming system determines that the randomly determined sections of the wheel are each associated with the color blue, the gaming system determines and provides the player a second different modifier (i.e., a bonus opportunity) that is associated with the color blue for a play of the primary game.

In other embodiments, the plurality of elements of the secondary matching game are associated with or otherwise represent a plurality of different cards. In one such embodiment, each of the cards includes or is associated with one of a plurality of different colors. The colors of the cards are associated with or otherwise represent the different characteristics or attributes. In this embodiment, upon an occurrence of a secondary matching game triggering event, the gaming system randomly selects a plurality of the cards. In this embodiment, the gaming system determines whether the designated relationship exists between the randomly selected cards (i.e., the randomly selected elements) by determining whether the randomly selected cards are each associated with the same color (or each belong to the same group or set of colors).

If the randomly selected cards are each associated with the same color (or the same group or set of colors), the gaming system determines which of the bonus opportunities to provide to the player based on that color (or that group or set of colors). That is, in these embodiments, each color (or each group or set of colors) is associated with one of the bonus opportunities, and the color (or group or set of colors) associated with the plurality of randomly generated cards having the designated relationship (i.e., sharing the same color or group or set of colors) determines which bonus opportunity to provide to the player. For example, if the gaming system determines that the randomly selected cards are each associated with the color yellow, the gaming system determines and provides the player a play of a first bonus game (i.e., a bonus opportunity) that is associated with the color yellow. Further, in this example, if the gaming system determines that the randomly selected cards are each associated with the color green, the gaming system determines and provides the player a play of a second different bonus game (i.e., a bonus opportunity) that is associated with the color green.

In certain embodiments, the gaming system is configured to operate a primary wagering game and a secondary game, such as a secondary trail game. The secondary trail game includes a plurality of elements or components, such as a plurality of positions of a trail or path. Each of the positions is associated with one of a plurality of different bonus opportunities, such as an increased award opportunity or at least one play of at least one bonus game. Upon an occurrence of a secondary trail game triggering event, the gaming system randomly determines a plurality of the positions, such as by randomly selecting one or more cards that are each associated with one of the positions. Additionally, the gaming system randomly determines a plurality or quantity of moves of a player symbol on the trail or path, such as by simulating a roll of one or more dice.

Following such multiple random determinations, the gaming system displays a player symbol at an initial one of the positions and moves the player symbol the randomly determined number of player symbol moves from the initial position to a final one of the positions. If the final position is one of the randomly determined positions (i.e., if the player symbol's randomly determined final position is one of the randomly determined positions), the gaming system provides the player the bonus opportunity associated with the final position. In these embodiments, certain of the bonus opportunities are more lucrative, valuable, or advantageous than others. For example, if the gaming system randomly determines a first position and the final one of the positions is the first position, the gaming system provides the player a first modifier for a play of the primary game. Further, in this example, if the gaming system randomly determines a second position and the final one of the positions is the second position, the gaming system provides the player a second different modifier for a play of the primary game.

It should thus be appreciated that selecting which of a plurality of bonus opportunities to provide to a player based on a plurality of different, displayed random determinations provides an increased level of excitement and enjoyment for certain players.

Additional features and advantages are described herein, and will be apparent from, the following Detailed Description and the Figures.

DETAILED DESCRIPTION

Figure 1:
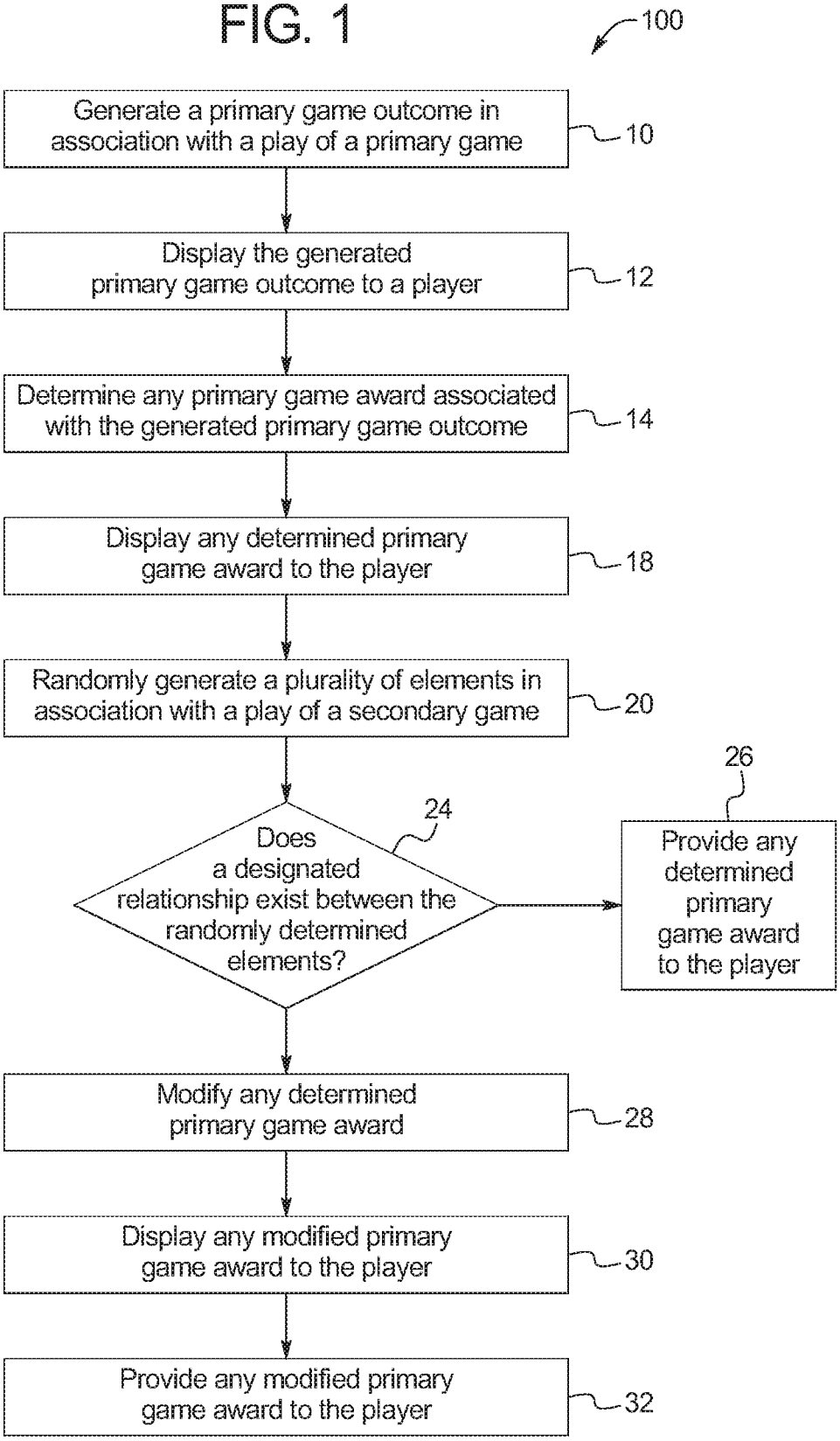
FIG. 1 is a flowchart illustrating a method of operating an example embodiment of the gaming system of the present disclosure.

Providing a Bonus Opportunity when a Designated Relationship Exists Between a Plurality of Randomly Determined Elements Various embodiments of the present disclosure are directed to a gaming system and method providing a bonus opportunity when a designated relationship exists between a plurality of randomly determined elements. While any credit balances, any wagers, and any awards are displayed as an amount of monetary credits or currency in the embodiments described below, one or more of such credit balances, such wagers, and such awards may be for non-monetary credits, promotional credits, and/or player tracking points or credits.

In certain embodiments, the gaming system is configured to operate a primary wagering game and a secondary game, such as a secondary matching game. The secondary matching game includes a plurality of different elements or components. In certain embodiments, each of the elements or components is associated with one of a plurality of different characteristics or attributes. In operation of certain embodiments, upon an occurrence of a secondary matching game triggering event, the gaming system randomly determines or selects a plurality of the elements (and in certain embodiments displays such random determinations). In one such embodiment, the gaming system separately or individually randomly determines each of such plurality of the elements.

Following this random determination(s), the gaming system determines whether a designated or predefined relationship exists between the randomly determined elements. In one embodiment, the designated relationship exists when the randomly determined elements are each associated with a same one of the characteristics. In another embodiment, the designated relationship exists when the randomly determined elements are each associated with a characteristic from a same group of a plurality of the characteristics. In these embodiments, if the designated relationship exists between the randomly determined elements, the gaming system provides the player one of a plurality of different bonus opportunities, such as an increased award opportunity or at least one play of at least one bonus game, wherein certain of the bonus opportunities are more lucrative, valuable, or advantageous than others. In various embodiments, the gaming system determines which of the bonus opportunities to provide to the player based on the characteristic (or characteristic group) associated with the randomly determined elements having the designated relationship. It should thus be appreciated that the secondary matching game of the present disclosure is configured to provide a bonus opportunity based not only on the existence of a designated relationship between a plurality of randomly determined elements, but also on the specific randomly determined elements between which the designated relationship exists.

In various embodiments, the secondary matching game includes an element generator or selector associated with the plurality of elements. In one such embodiment, the element generator includes one or more wheels each having a plurality of colored sections. In this embodiment, the sections of the wheel(s) are associated with or otherwise represent the different elements or components, and the colors of the sections are associated with or otherwise represent the different characteristics or attributes. In operation of this embodiment, upon an occurrence of a secondary matching game triggering event, the gaming system spins the wheel(s) to randomly determine or select a plurality of the sections of the wheel(s) (i.e., the element generator randomly selects a plurality of the elements). In this embodiment, the gaming system determines whether the designated relationship exists between the randomly determined sections of the wheel(s) by determining whether the randomly determined sections of the wheel(s) are each associated with the same color (or each belong to the same group or set of colors).

In this embodiment, if the randomly determined sections of the wheel are each associated with the same color (or each belong to the same group or set of colors), the gaming system determines which of a plurality of different bonus opportunities to provide to the player based on the color (or the group or set of colors) of the sections having the designated relationship. That is, in these embodiments, each color (or each group or set of colors) is associated with one of the bonus opportunities, and the color (or group or set of colors) associated with the plurality of randomly generated sections having the designated relationship (i.e., sharing the same color or group or set of colors), determines which bonus opportunity to provide to the player. The gaming system then provides the player the determined bonus opportunity. For example, if the gaming system determines that the randomly determined sections of the wheel are each associated with the color orange, the gaming system determines and provides the player a first modifier (i.e., a bonus opportunity) that is associated with the color orange for a play of the primary game. Further, in this example, if the gaming system determines that the randomly determined sections of the wheel are each associated with the color blue, the gaming system determines and provides the player a second different modifier (i.e., a bonus opportunity) that is associated with the color blue for a play of the primary game.

FIG. 1 illustrates a flowchart of an example process or method 100 of operating the gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In this example, the gaming system is configured to operate a primary game and a secondary game in association with the primary game. For a play of the primary game, the gaming system generates a primary game outcome, as indicated by block 10. The gaming system displays the generated primary game outcome to a player, as indicated by block 12. The gaming system determines any primary game award associated with the generated primary game outcome, as indicated by block 14. The gaming system displays any determined primary game award to the player, as indicated by block 16.

For a play of the secondary game in association with the play of the primary game, the gaming system randomly generates a plurality of elements, as indicated by block 18. The gaming system determines if a designated relationship exists between the randomly determined elements, as indicated by diamond 20. If the designated relationship does not exist between the randomly determined elements, the gaming system provides any determined primary game award to the player, as indicated by block 22. If, on the other hand, the designated relationship exists between the randomly determined elements, the gaming system modifies any determined primary game award, as indicated by block 24. The gaming system displays any modified primary game award to the player, as indicated by block 26. The gaming system provides any modified primary game award to the player, as indicated by block 28.

FIGS. 2, 3, 4, 5, and 6 illustrate screen shots of an example of an embodiment of the gaming system of the present disclosure that is configured to provide a bonus opportunity when a designated relationship exists between a plurality of randomly determined elements. In this example, the gaming system is configured to operate a primary poker game and a secondary matching game. More specifically, the gaming system is configured to display: (a) a play of the primary poker game upon a placement of a primary wager by a player, and (b) a play of the secondary matching game in association with the play of the primary poker game. In one embodiment, the play of the secondary matching game is based upon a placement of a secondary wager by the player in addition to the primary wager. In another embodiment, the play of the secondary matching game occurs without any placement of any secondary wager. For the play of the secondary matching game, the gaming system randomly determines a plurality of elements and determines whether a designated relationship exists between those randomly determined elements. If the designated relationship exists between those randomly determined elements, the gaming system determines and provides a bonus opportunity to the player that is usable or applicable in the play of the primary poker game with which the play of the secondary matching game is associated.

Turning to the secondary matching game, in this example, the gaming system displays an element generator or selector 200 including a concentric wheel 205 for use in the secondary matching game. In this example, wheel 205 includes an outer concentric wheel or wheel portion 210, an inner concentric wheel or wheel portion 230, and a middle concentric wheel or wheel portion 220 positioned between outer concentric wheel portion 210 and inner concentric wheel portion 230. Each of outer concentric wheel portion 210, middle concentric wheel portion 220, and inner concentric wheel portion 230 includes a plurality of sections (i.e., elements in this example). In this illustrated example, each of the concentric wheel portions is associated with ten sections. Each of the sections is associated with one of a plurality of different colors (i.e., characteristics in this example). It should be appreciated that the different colors are represented by different patterns in the accompanying Figures. More specifically, in this illustrated example, each of the sections is associated with one of the following colors: red (represented by the vertical line pattern), blue (represented by the horizontal line pattern), orange (represented by the cross-hatched pattern), pink (represented by the pattern including multiple distinct rows of hatching), and green (represented by the hatched pattern). Element generator 200 also includes a section indicator 240 configured to simultaneously indicate one section of each of the concentric wheel portions of wheel 205 following a spin of each of the concentric wheel portions (as described below).

For a play of the secondary matching game in this illustrated example, the gaming system randomly determines a plurality of the sections of wheel 205 by independently spinning and stopping each of the concentric wheel portions of wheel 205 such that section indicator 240 indicates one section of each of the concentric wheel portions. The sections indicated by section indicator 240 of this example embodiment are the randomly determined sections. In other words, in this example, the gaming system separately or independently randomly determines one section of each concentric wheel portion of wheel 205. Following these random determinations, the gaming system determines whether a designated relationship exists among the randomly determined sections by determining whether the randomly determined sections are each associated with the same color. If the randomly determined sections are each associated with the same color, the gaming system determines a bonus opportunity associated with that color, and provides the determined bonus opportunity to the player. If the randomly determined sections are not each associated with the same color, the gaming system does not provide any bonus opportunity to the player.

In this example, each color is associated with one of a plurality of different bonus opportunities that are modifiers, such as multipliers usable in the play of the primary poker game with which a play of the secondary matching game is associated. Specifically, in this example, the gaming system displays a secondary matching game bonus opportunity table 214 that indicates the following bonus opportunities: a 2× multiplier associated with the color green, a 3× multiplier associated with the color pink, a 5× multiplier associated with the color orange, an 8× multiplier associated with the color blue, and a 10× multiplier associated with the color red.

Turning to the primary poker game, the gaming system displays a player hand display area 150 at which the playing cards of the initial player hand and the playing cards of the final player hand are displayed, as described in detail below. The gaming system also displays a primary poker game paytable 112 that indicates a plurality of winning outcomes for a play of the primary poker game and an award associated with each such winning outcome.

The gaming system also displays: a credit meter 114, which displays the player's credit balance in the form of an amount of currency in this illustrated example; a wager indicator 116, which displays the player's primary wager and the player's secondary wager (if any) in the form of an amount of currency in this illustrated example; and an award meter 118 (shown in FIG. 6), which displays any award or awards won by the player in the form of an amount of currency in this example. While in this illustrated example the gaming system indicates the player's credit balance, the player's wagers, and any awards in the form of amounts of currency, it should be appreciated that such indications may alternatively or additionally be made in the form of quantities of credits.

In this illustrated example, display device 110 additionally displays the following buttons, each of which is activatable by a player (such as through use of a touch screen as described below): SEE PAYS button 131, OPTIONS button 132, SPEED button 133, BET DOWN button 134, BET UP button 135, BONUS button 136, and DEAL button 137. In this example, when the gaming system receives an indication that the player has activated SEE PAYS button 131, if primary poker game paytable 112 is not displayed, the gaming system displays primary poker game paytable 112, and if primary poker game paytable 112 is displayed, the gaming system removes primary poker game paytable 112 such that it is hidden (i.e., not displayed). In this example, when the gaming system receives an indication that the player has activated OPTIONS button 132, the gaming system displays a plurality of customizable options related to the primary poker game to the player, such as card back design options, background color options, background music options, and the like. In this example, when the gaming system receives an indication that the player has activated SPEED button 133, the gaming system increases or decreases the speed at which the gaming system displays plays of the primary poker game and the secondary matching game. In this example, when the gaming system receives an indication that the player has activated BET DOWN button 134, the gaming system reduces the player's primary wager by a designated amount (such as one credit or $0.25). In this example, when the gaming system receives an indication that the player has activated BET UP button 134, the gaming system increases the player's primary wager by a designated amount (such as one credit or $0.25). In this example, when the gaming system receives an indication that the player has activated BONUS button 136, the gaming system adds a secondary wager to activate the secondary matching game in association with a play of the primary poker game. That is, the gaming system enables the player to activate BONUS button 136 to place (or remove) the secondary wager and activate the secondary matching game in association with a play of the primary poker game. In this example, when the gaming system receives an indication that the player has activated DEAL button 137, the gaming system initiates a play of the primary poker game (if the player has placed a suitable primary wager) and a play of the secondary matching game (if the player has placed the secondary wager).

Figure 2:
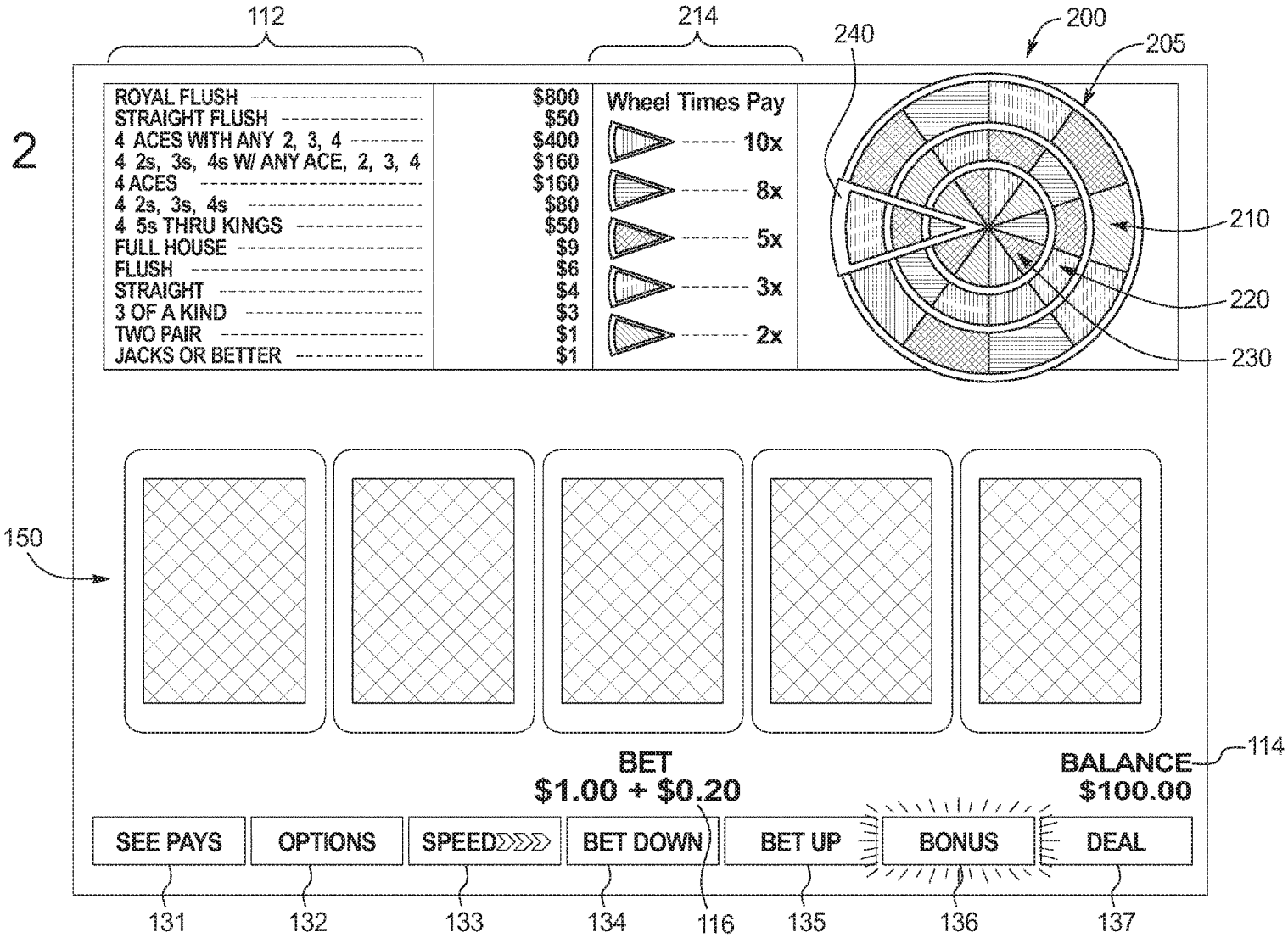
FIGS. 2 to 6 illustrate screen shots of an example embodiment of the gaming system of the present disclosure configured to operate a secondary matching game including an element generator configured to randomly determine a plurality of elements.

In this illustrated example, as shown in FIG. 2 and as indicated by wager indicator 116, the gaming system receives a primary wager of $1.00 from a player for a play of the primary poker game and a secondary wager of $0.20 from the player to activate the secondary matching game in association with the play of the primary poker game. That is, the gaming system receives an indication that the player activated BONUS button 136 to place the secondary wager to activate the secondary matching game. In this example, the gaming system displays an indication associated with BONUS button 136 (such as colors BONUS button 136 red) when the player places the secondary wager to indicate that the secondary matching game is active. It should be appreciated that, in this example, the gaming system enables the player to place the secondary wager to activate the secondary matching game regardless of an amount of the primary wager. After receiving the player's primary and secondary wagers, the gaming system enables the player to activate DEAL button 137 to initiate a play of the primary poker game and, because the player placed the secondary wager to activate the secondary matching game, a play of the secondary matching game.

In this illustrated example, the secondary wager required to activate or initiate a play of the secondary matching game in association with a play of the primary poker game has a secondary wager amount that is 20% of an amount of the primary wager placed on the play of the primary poker game. It should be appreciated, however, that the secondary wager amount may be any suitable percentage (such as 50% or 100%) of the primary wager amount or any other suitable amount.

Figure 3:
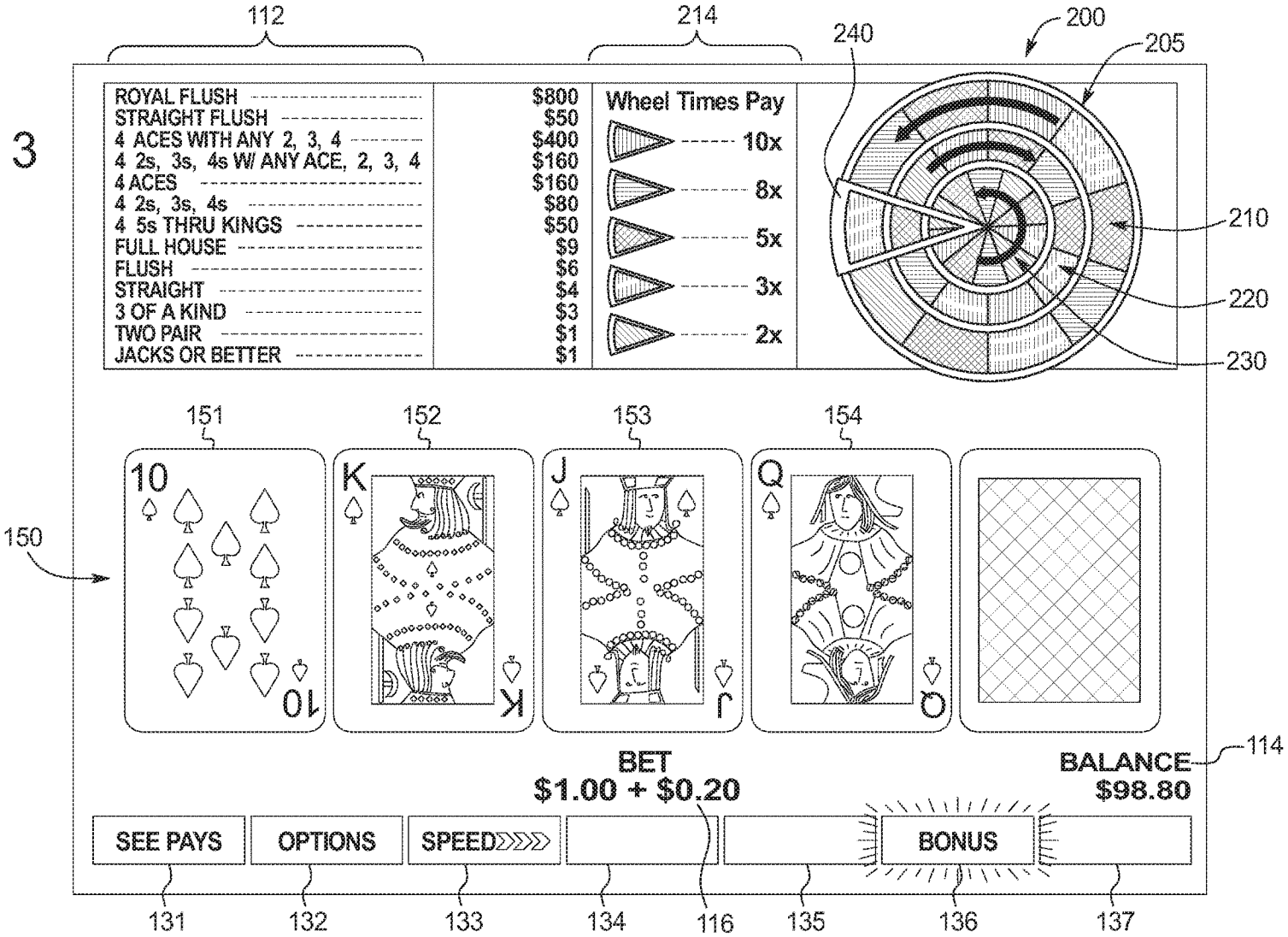
Figure 4:
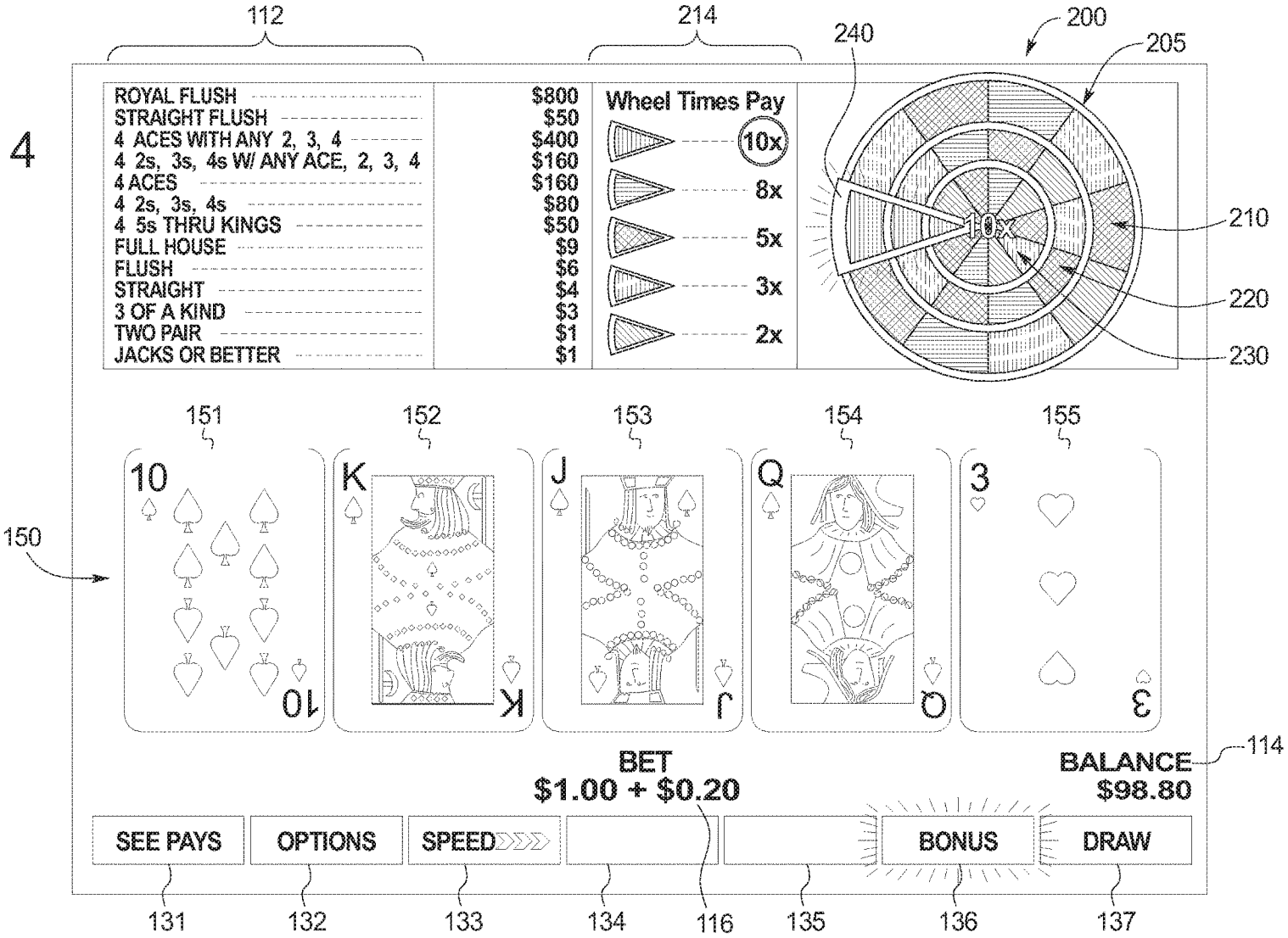

As shown in FIGS. 3 and 4, in this example, after receiving an indication that the player has activated DEAL button 137, the gaming system randomly selects and displays five cards from a deck of a plurality of cards to form an initial player hand for the play of the primary poker game. In this example, the deck of cards is a deck of fifty-two standard playing cards, though it should be appreciated that any suitable plurality of cards may be employed. As generally described above, for the play of the secondary matching game, the gaming system randomly determines one of the sections of each of the concentric wheel portions of wheel 205 by independently spinning and stopping each of the concentric wheel portions such that one of the sections of each concentric wheel portion is indicated by section indicator 240. Put differently, the sections indicated by section indicator 240 are the randomly determined sections for the play of the secondary matching game. More specifically, in this example, upon receiving the indication that the player has activated DEAL button 137, the gaming system begins: (a) randomly selecting and dealing cards from the deck of cards to form the initial player hand, and (b) independently spinning the concentric wheel portions of wheel 205. When the gaming system randomly selects and displays the final card of the initial player hand, the gaming system stops spinning each of the concentric wheel portions of wheel 205 such that one of the sections of each concentric wheel portion is indicated by section indicator 240.

In this illustrated example, as shown in FIG. 4, the gaming system randomly selects and displays the following cards from the deck of cards to form the initial player hand: a Ten of spades 151, a King of spades 152, a Jack of spades 153, a Queen of spades 154, and a Three of hearts 155. Additionally, as indicated by section indicator 240, the gaming system randomly determines a section of each of the concentric wheel portions of wheel 205 associated with the color red.

In this illustrated example, as noted above and as shown in FIGS. 4 and 5, the randomly determined sections (i.e., the sections indicated by section indicator 240) are each associated with the color red. In this illustrated example, the color red is associated with a 10× multiplier. Thus, the gaming system provides the player with the 10× multiplier for use in the play of the primary poker game. In this illustrated example, as shown in FIG. 5, the gaming system displays a multiplier indicator 215 indicating that the 10× multiplier is active for or applicable to the play of the primary poker game.

In this example, after providing the bonus opportunity to the player, for the play of the primary poker game, the gaming system enables the player to select one or more cards in the initial player hand to discard. If the player selects one or more cards in the initial player hand to discard, the gaming system discards the selected cards and replaces the discarded cards with one or more replacement cards randomly selected from the deck of cards to form a final player hand. After replacing any discarded cards with any replacement cards to form the final player hand, the gaming system determines whether the final player hand includes a winning outcome by comparing the final player hand (or the initial player hand if no cards were replaced) with the winning outcomes indicated by primary poker game paytable 112. If the gaming system determines that the final player hand (or the initial player hand if no cards were replaced) includes one of the winning outcomes indicated by primary poker game paytable 112, the gaming system provides the award associated with that winning outcome to the player or, if any modifiers are active, modifies the award associated with that winning outcome using the active modifier(s) and provides the modified award to the player.

Figure 5:
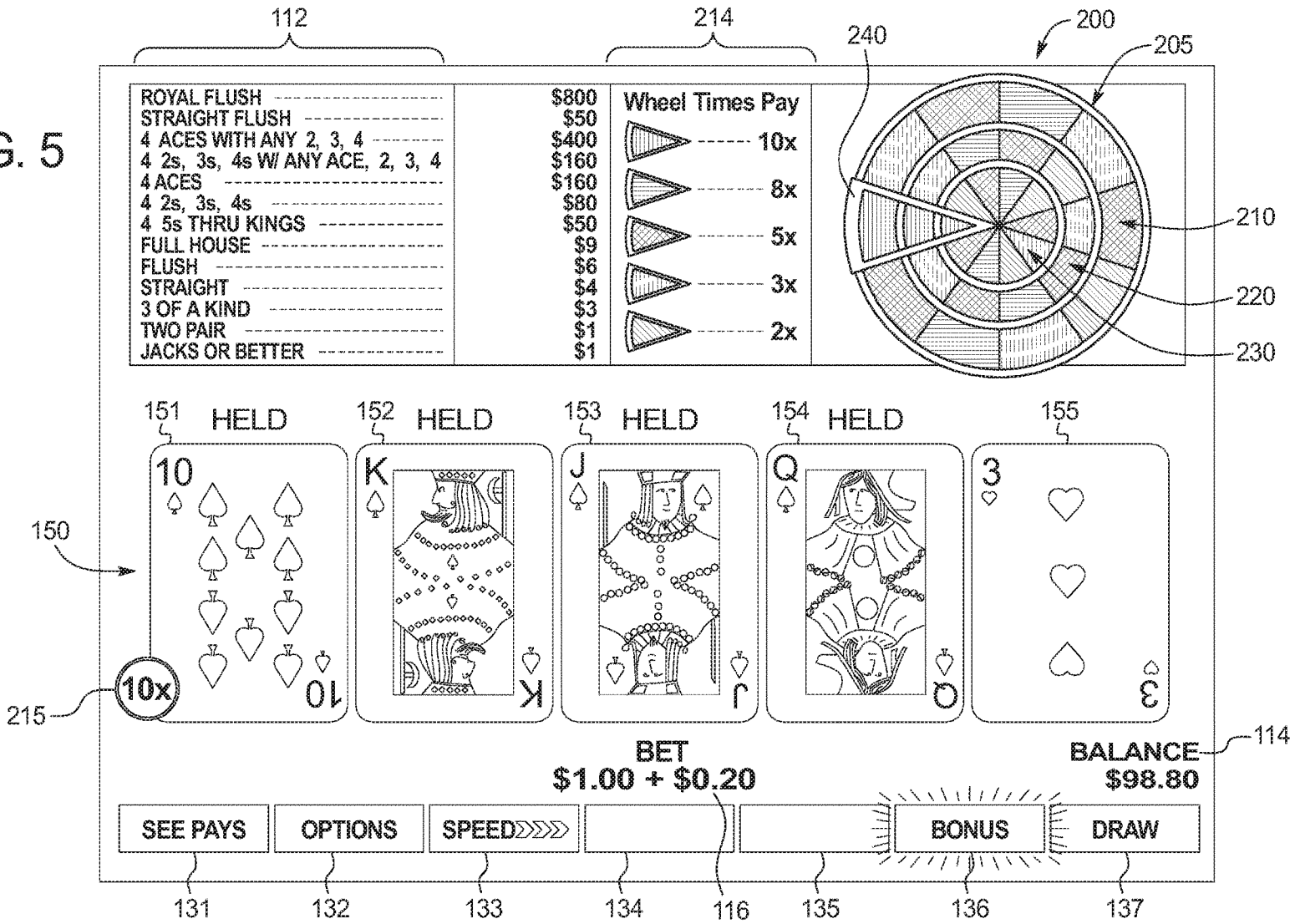
Figure 6:
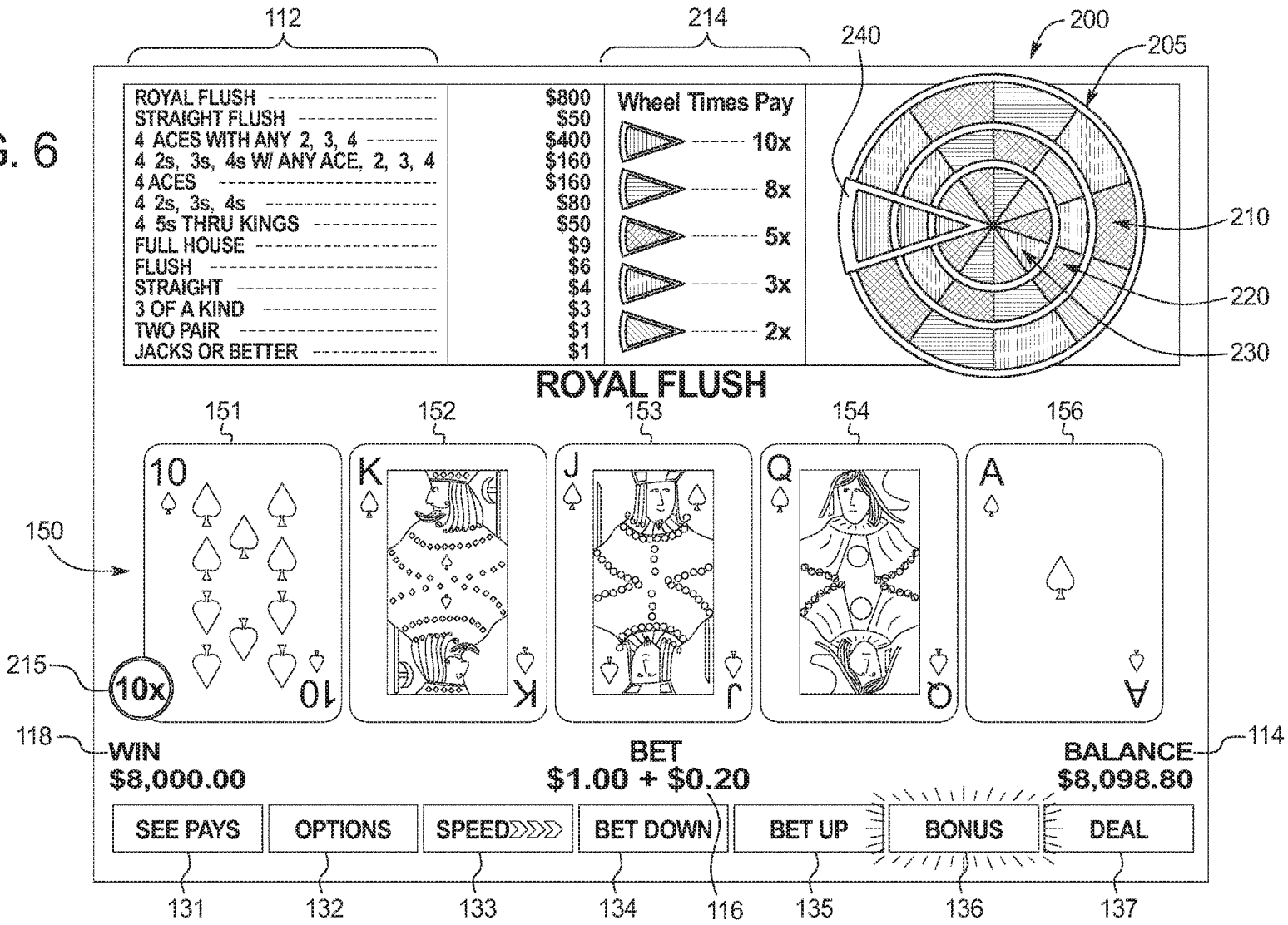

In this illustrated example, as shown in FIGS. 5 and 6, the gaming system receives an indication from the player to discard Three of hearts 155 from the initial player hand. The gaming system discards Three of hearts 155 and randomly determines and displays the Ace of spades 165 to replace Three of hearts 155, forming the final player hand. The gaming system determines that the final player hand includes the Royal Flush winning outcome indicated by primary poker game paytable 112. The Royal Flush winning outcome is associated with an award of $800.00 in this example. Since the 10× modifier provided through play of the secondary matching game was active, the gaming system modifies the award of $800.00 with the 10× multiplier (i.e., multiplied the award of $800.00 by ten), and provides the modified award of $8,000.00 to the player, as indicated by award meter 118. The gaming system updates the player's credit balance such that credit meter 114 reflects the award of $8,000.00.

In certain embodiments, when a player does not place the secondary wager to activate the secondary matching game in association with a play of the primary poker game, the gaming system dims the wheel but, nevertheless, randomly determines a plurality of the sections by spinning and stopping the concentric wheel portions such that one section of each concentric wheel portion is indicated by the section indicator. In such instances, however, the gaming system does not provide any bonus opportunities to the player, even if the randomly determined sections are each associated with a same color (i.e., even if the designated relationship exists among the randomly determined sections).

In the example described above and illustrated in FIGS. 2 to 6, the gaming system enables the player to place the secondary wager to activate the secondary matching game in association with a play of the primary poker game regardless of an amount of the primary wager. In other embodiments, the gaming system enables the player to place the secondary wager to activate the secondary matching game in association with a play of the primary poker game if an amount of the primary wager is at least a designated amount such as a designated quantity of credits or a designated amount of currency (such as a quantity of credits or an amount of currency equal to a maximum wager).

In the example described above and illustrated in FIGS. 2 to 6, the gaming system randomly determines the sections of the wheel (i.e., randomly determines the plurality of elements) while the gaming system randomly selects and displays the cards of the initial player hand. In other embodiments, the gaming system randomly determines the sections of the wheel: (a) before randomly selecting and displaying the cards of the initial player hand, (b) after randomly selecting and displaying the cards of the initial player hand, (c) while randomly selecting and displaying any replacement cards to replace any discarded cards to form the final player hand, or (d) after randomly selecting and displaying any replacement cards to replace any discarded cards to form the final player hand. Put differently, in various embodiments, the gaming system randomly determines the plurality of elements at any suitable point in time with respect to the associated play of the primary game.

In certain embodiments, the gaming system randomly determines certain of the sections (i.e., elements) at a plurality of different points in time. In one such embodiment, the gaming system randomly determines two of three sections while randomly selecting and displaying the cards of the initial player hand, and randomly determines the third section after forming the final player hand. In other embodiments, the gaming system randomly determines the sections differently based on the speed of play selected by the player. In one such embodiment, the speed with which the gaming system spins the concentric wheel portions to randomly determine the sections increases as the speed of play selected by the player increases. That is, in this example, the gaming system employs the same mechanism for randomly selecting the sections, but changes the speed at which that mechanism is employed or displayed based on the speed of play selected by the player. In another such embodiment, the gaming system changes the mechanism used to randomly determine the sections based on the speed of play selected by the player. For example, the gaming system employs a wheel having four concentric wheel portions when a relatively low speed of play is selected by the player, and the gaming system employs a wheel having two concentric wheel portions when a relatively high speed of pay is selected by the player.

In the example described above and illustrated in FIGS. 2 to 6, the gaming system does not provide any bonus opportunity to the player if the randomly determined sections are not each associated with the same color (i.e., the randomly determined elements are not associated with the same characteristic). In various embodiments, the gaming system provides another play of the secondary matching game in association with the play of the primary poker game (i.e., another spin of the concentric wheel portions of the wheel in terms of the above example) when: (a) the randomly determined sections are not each associated with a same color; and (b) an outcome of the primary poker game is a designated outcome (such as a Two Pair outcome, a Three of a Kind through Flush outcome, or a Four of a Kind outcome). In other embodiments, the gaming system provides another play of the secondary matching game in association with the play of the primary poker game (i.e., another spin of the concentric wheel portions of the wheel in terms of the above example) when: (a) the randomly determined sections are not each associated with a same color; and (b) an outcome on the deal is a designated deal outcome and an outcome on the draw is a designated draw outcome (such as: a player being dealt a Three of a Kind on the deal and not obtaining Four of a Kind on the draw, a player holding one or more cards to a Straight Flush on the deal and earning a Flush on the draw, and a player holding Two Pair on the deal and earning a Full House on the draw).

In the example described above and illustrated in FIGS. 2 to 6, the secondary matching game triggering event occurs when: (a) the gaming system receives a secondary wager from a player in addition to a primary wager, and (b) the gaming system receives an indication that the player activated the DEAL button. It should be appreciated, however, that the secondary matching game triggering event may occur upon any suitable event or events, such as one or more of those described below.

Figure 7:
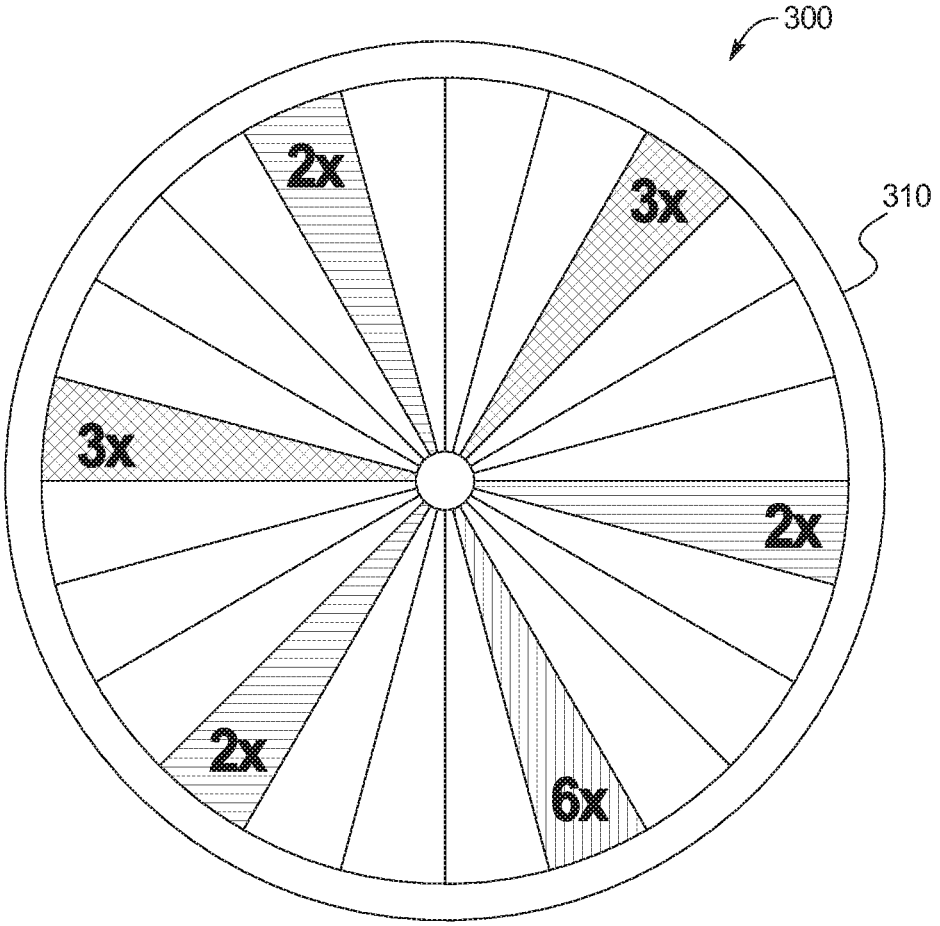
FIG. 7 illustrates a screen shot of an alternative embodiment of the element generator.

FIG. 7 illustrates an alternative embodiment of the element generator of the present disclosure. In this embodiment, element generator 300 includes a wheel 310, which includes a plurality of sections (i.e., elements), and an indicator (not shown). In this illustrated embodiment, each of at least one of, but less than all of, the sections of wheel 310 are associated with one of a plurality of different bonus opportunities (multipliers in this example), though it should be appreciated that in other embodiments each of the sections of the wheel is associated with one of the bonus opportunities. Upon an occurrence of the secondary matching game triggering event, the gaming system randomly determines one of the sections of wheel 310 by spinning and stopping wheel 310 such that the indicator indicates one of the sections. If the indicated section is associated with one of the bonus opportunities, the gaming system provides that bonus opportunity to the player.

Figure 8A:
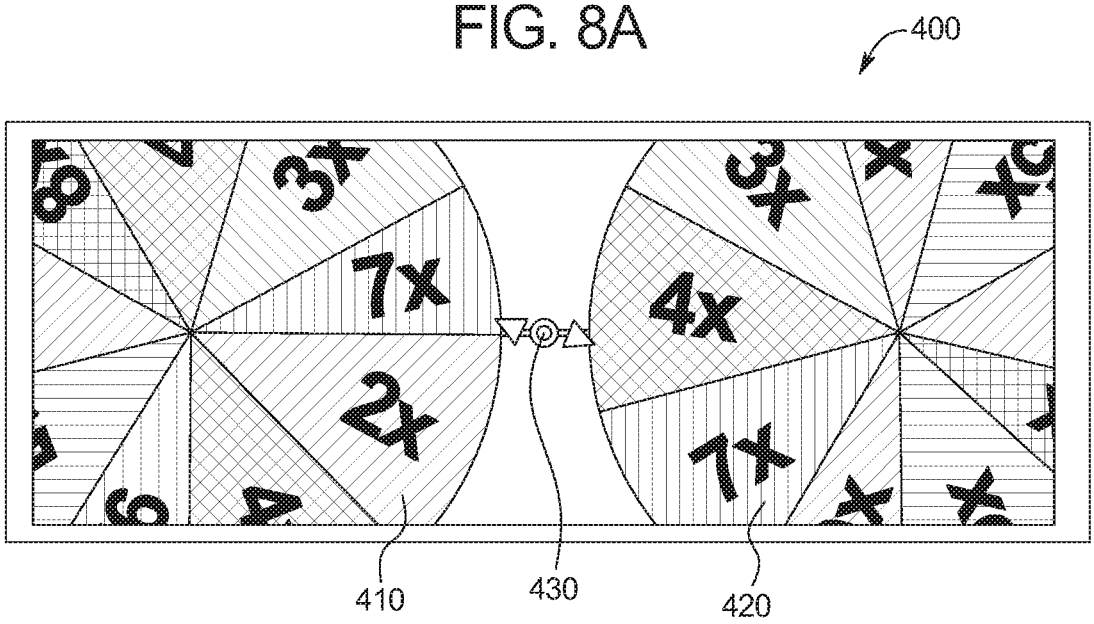
FIG. 8A illustrates a screen shot of another alternative embodiment of the element generator.

FIG. 8A illustrates another alternative embodiment of the element generator of the present disclosure. In this embodiment, element generator 400 includes wheels 410 and 420, each of which includes a plurality of sections (i.e., elements), and an indicator 430 configured to simultaneously indicate one of the sections of each of wheels 410 and 420. In this illustrated embodiment, each of the sections of each of the wheels is associated with one of a plurality of different bonus opportunities (multipliers in this example). Upon an occurrence of the secondary matching game triggering event, the gaming system randomly determines one of the sections of each of the wheels by spinning and stopping the wheels such that indicator indicates one of the sections of each of the wheels. When the indicated sections are each associated with a same one of the bonus opportunities, the gaming system provides that bonus opportunity to the player.

Figure 8B:
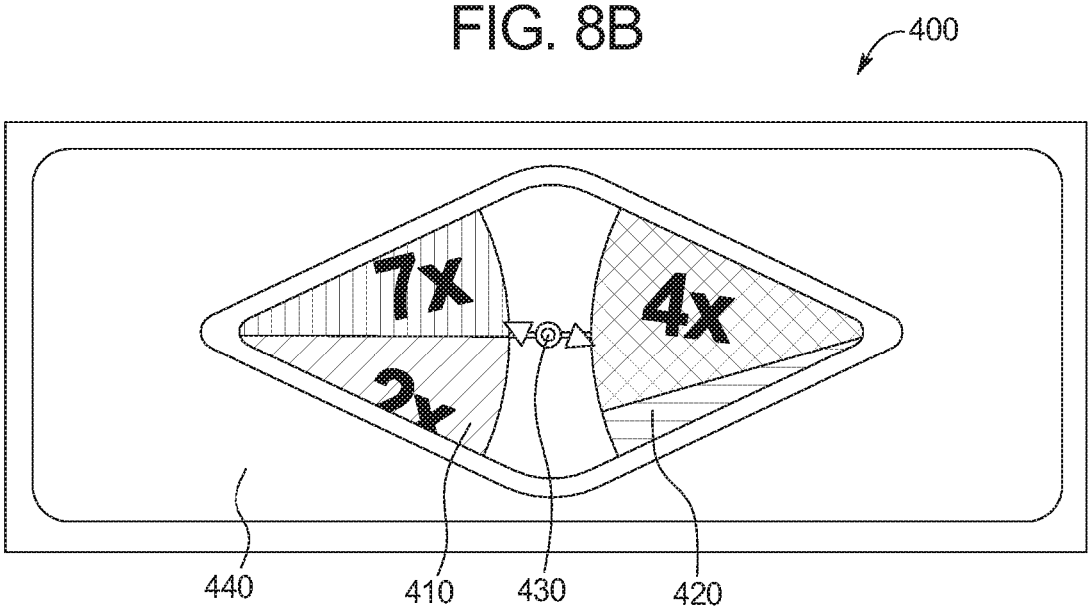
FIG. 8B illustrates a screen shot of another alternative embodiment of the element generator.

FIG. 8B illustrates another embodiment of element generator 400 described above. In this embodiment, element generator 400 includes a mask 440 configured to hide a portion of wheels 410 and 420, such as a portion of the wheels located relatively far from the indicator. This enables a player to focus on the indicator and the sections of the wheels indicated by the indicator without being distracted by other sections of the spinning wheels.

Figure 9:
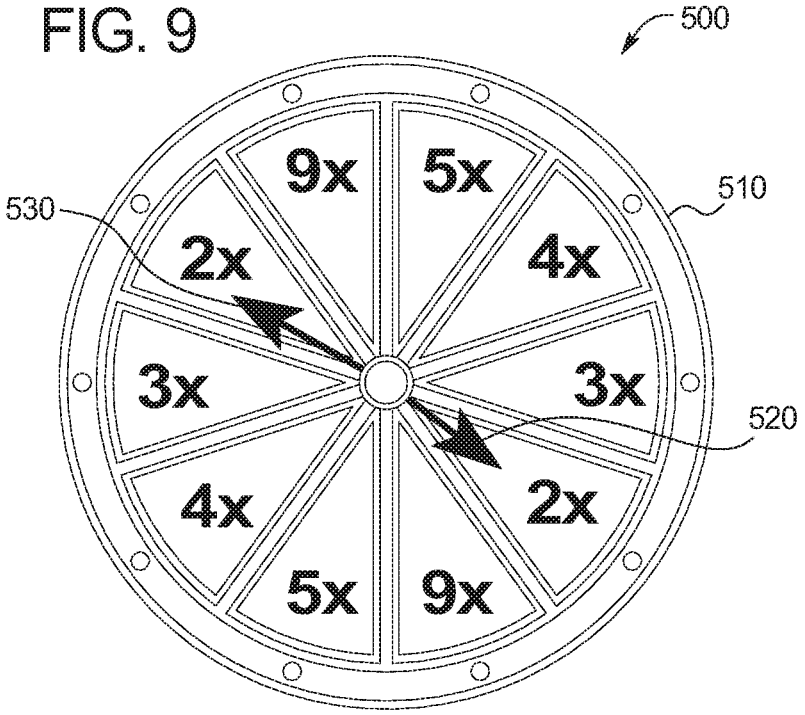
FIG. 9 illustrates a screen shot of another alternative embodiment of the element generator.

FIG. 9 illustrates another alternative embodiment of the element generator of the present disclosure. In this embodiment, element generator 500 includes a wheel 510, which includes a plurality of sections (i.e., elements), and a plurality of indicators 520 and 530, each of which is configured to separately indicate one of the sections of wheel 510. In this illustrated embodiment, each of the sections is associated with one of a plurality of different bonus opportunities (multipliers in this example). Upon an occurrence of the secondary matching game triggering event, the gaming system randomly determines one of the sections of wheel 510 for each of indicators 520 and 530 by spinning and stopping the indicators such that each indicator indicates one of the sections of the wheel. In one embodiment, the gaming system spins the wheel in addition to spinning the indicators (such as before, during, or after spinning the indicators), while in another embodiment the gaming system does not spin the wheel in addition to spinning the indicators. In certain embodiments, when indicators 520 and 530 both indicate a same one of the sections, the gaming system provides the bonus opportunity associated with that section to the player. In other embodiments, if indicators 520 and 530 each indicate a section associated with a same one of the bonus opportunities, the gaming system provides the bonus opportunity associated with the indicated sections to the player.

Figure 10:
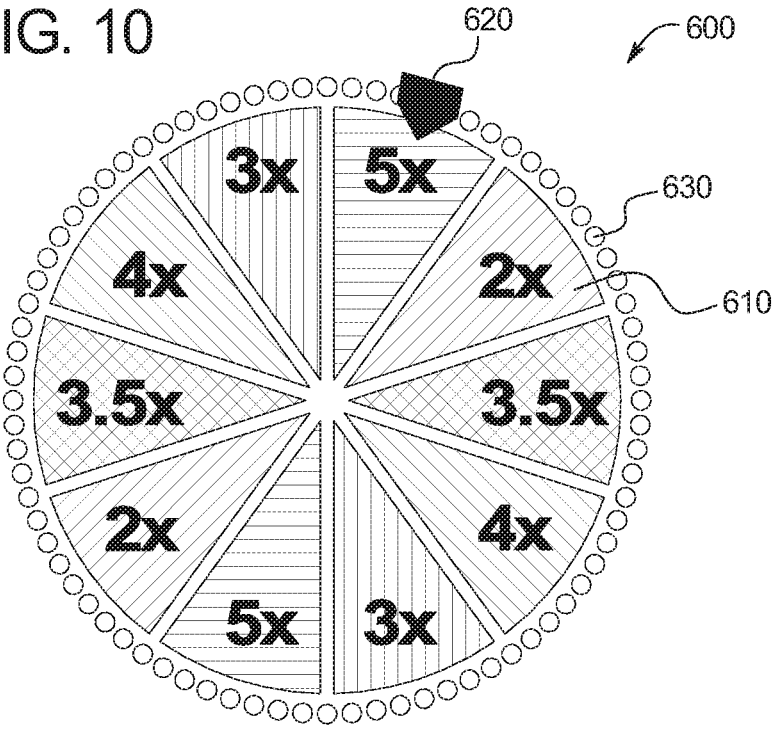
FIG. 10 illustrates a screen shot of another alternative embodiment of the element generator.

FIG. 10 illustrates another alternative embodiment of the element generator of the present disclosure. In this embodiment, element generator 600 includes a wheel 610, which includes a plurality of sections (i.e., elements); a pointer indicator 620; and a chasing light indicator 630. Pointer indicator 620 and chasing light indicator 630 are each configured to separately indicate one of the sections of wheel 610. In this illustrated embodiment, each of the sections is associated with one of a plurality of different bonus opportunities (multipliers in this example). Upon an occurrence of the secondary matching game triggering event, the gaming system randomly determines one of the sections of wheel 610 for pointer indicator 620 and one of the sections of wheel 610 for chasing light indicator 630 by spinning the respective indicators around wheel 610 in opposite directions (or in the same direction in certain embodiments) and stopping the respective indicators such that each indicates one of the sections of wheel 610. In one embodiment, the gaming system spins the wheel in addition to spinning the indicators (such as before, during, or after spinning the indicators), while in another embodiment the gaming system does not spin the wheel in addition to spinning the pointer indicator and the chasing light indicator. In certain embodiments, if pointer indicator 620 and chasing light indicator 630 both indicate a same one of the sections, the gaming system provides the bonus opportunity associated with that section to the player. In other embodiments, if pointer indicator 620 and chasing light indicator 630 each indicate a section associated with a same one of the bonus opportunities, the gaming system provides the bonus opportunity associated with the indicated sections to the player.

Figure 11:
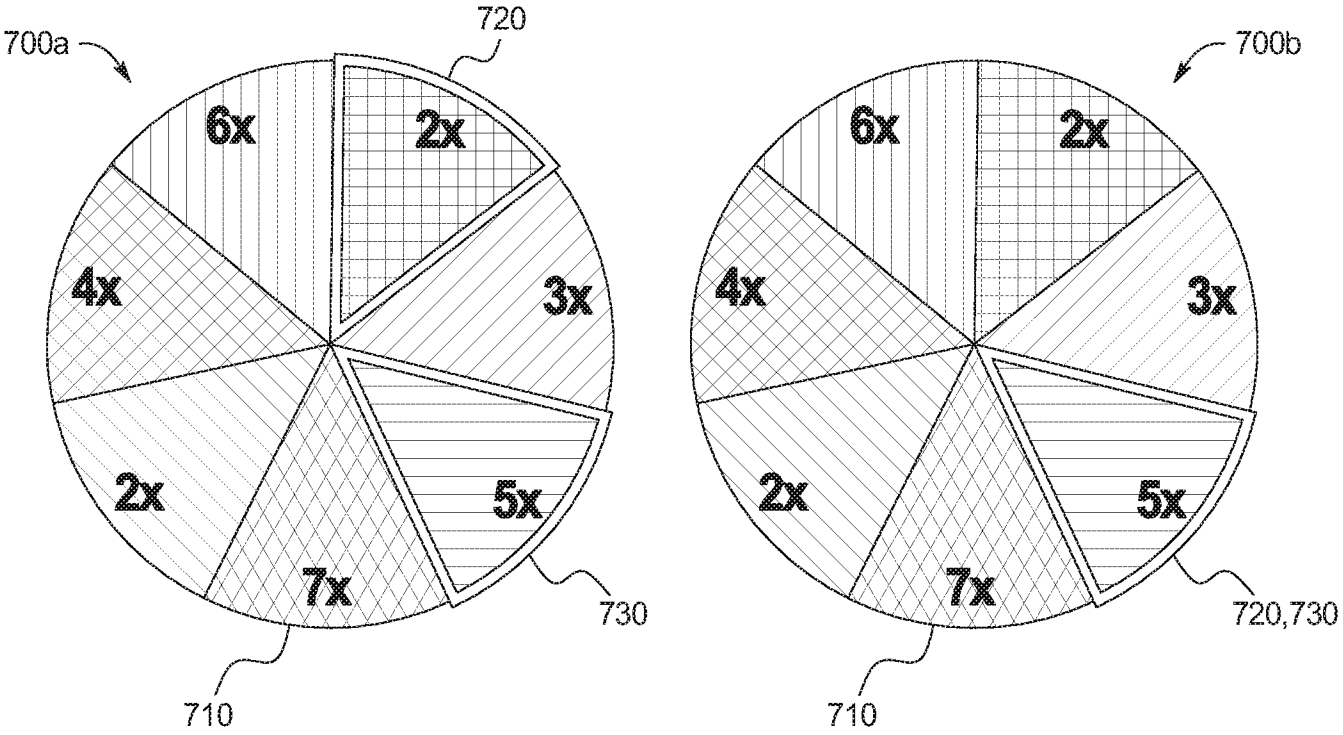
FIG. 11 illustrates a screen shot of another alternative embodiment of the element generator.

FIG. 11 illustrates another alternative embodiment of the element generator of the present disclosure. In this embodiment, element generator 700 includes a wheel 710, which includes a plurality of sections (i.e., elements); a first lighted indicator 720; and a second lighted indicator 730. First and second lighted indicators 720 and 730 are each configured to separately indicate one of the sections of wheel 710. In this illustrated embodiment, each of the sections is associated with one of a plurality of different bonus opportunities (multipliers in this example). Upon an occurrence of the secondary matching game triggering event, as shown in element generator 700*a*, the gaming system randomly determines one of the sections of wheel 710 for first lighted indicator 720 and second lighted indicator 730 by spinning the indicators around wheel 710 in opposite directions (or in the same direction in certain embodiments) and stopping the indicators such that each indicates one of the sections of wheel 710. In one embodiment, the gaming system spins the wheel in addition to spinning the lighted indicators, while in another embodiment the wheel is static while the first lighted indicator and the second lighted indicator spin. In certain embodiments, if first lighted indicator 720 and second lighted indicator 730 both indicate a same one of the sections, as illustrated in the rightmost element generator 700*b* shown in FIG. 11, the gaming system provides the bonus opportunity associated with that section to the player. In one such embodiment in which the first and second lighted indicators are different colors, the first and second lighted indicators combine to display a different color when the first and second lighted indicators each indicate a same one of the sections. In other embodiments, if first lighted indicator 720 and second lighted indicator 730 each indicate a section associated with a same one of the bonus opportunities, the gaming system provides the bonus opportunity associated with the indicated sections to the player.

Figure 12:
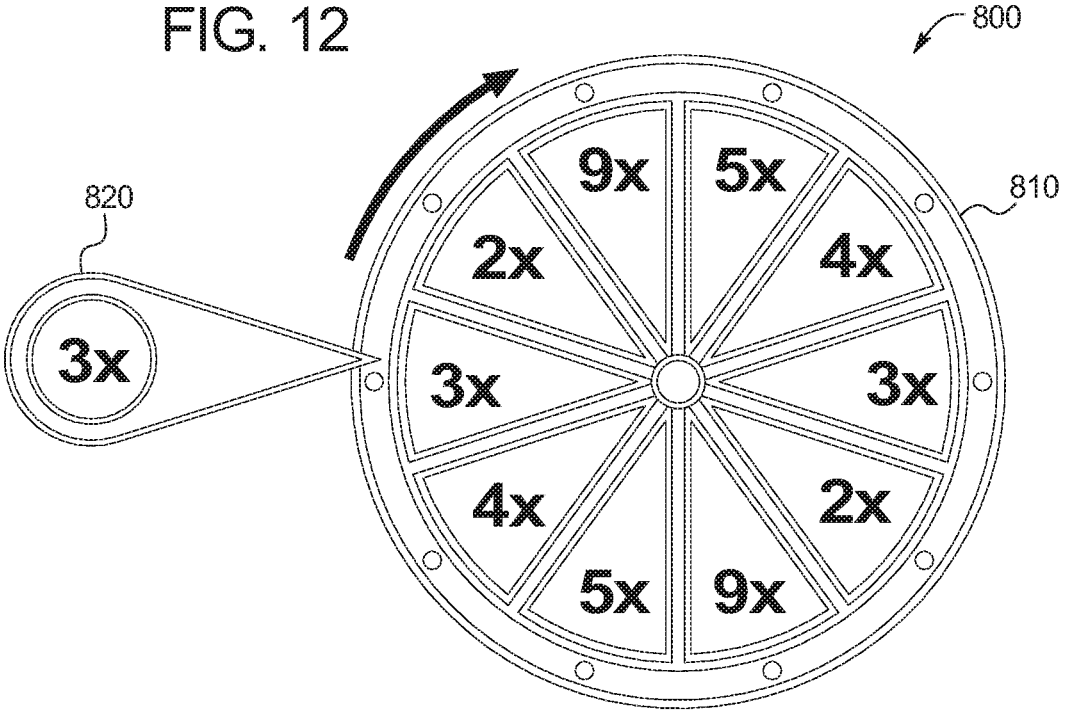
FIG. 12 illustrates a screen shot of another alternative embodiment of the element generator.

FIG. 12 illustrates another alternative embodiment of the element generator of the present disclosure. In this embodiment, element generator 800 includes a wheel 810, which includes a plurality of sections (i.e., elements), and an indicator 820 configured to indicate one of the sections of wheel 810. In this illustrated embodiment, each of the sections is associated with one of a plurality of different bonus opportunities (multipliers in this example). Upon an occurrence of the secondary matching game triggering event, the gaming system randomly determines one of the sections and associates that randomly determined section with indicator 820. The gaming system randomly determines one of the sections of wheel 810 by spinning and stopping wheel 810 such that indicator 820 indicates one of the sections of wheel 810. When the bonus opportunity associated with indicator 820 is the same as the bonus opportunity associated with the section of wheel 810 indicated by indicator 820, the gaming system provides that bonus opportunity to the player.

Figure 13:
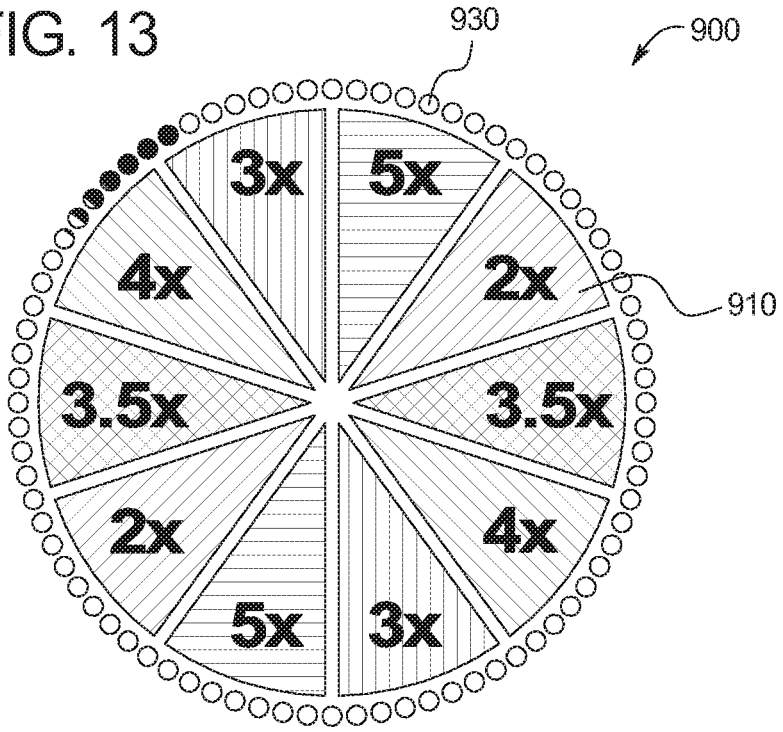
FIG. 13 illustrates a screen shot of another alternative embodiment of the element generator.

FIG. 13 illustrates another alternative embodiment of the element generator of the present disclosure. In this embodiment, element generator 900 includes a wheel 910, which includes a plurality of sections (i.e., elements), and a chasing light indicator 930 configured to indicate one of the sections of wheel 910. Each section of wheel 910 is associated with one of a plurality of different bonus opportunities (multipliers in this example). In this embodiment, each section of wheel 910 is associated with another section of wheel 910 that is associated with a same one of the bonus opportunities to form a set of sections. In this embodiment, upon an occurrence of the secondary matching game triggering event, the gaming system sequentially lights or otherwise indicates each set of sections and determines one of the sets, and randomly determines one of the sections of wheel 910 by spinning chasing light indicator 930 around wheel 910 and stopping chasing light indicator 930 such that chasing light indicator 930 indicates one of the sections of wheel 910. If chasing light indicator 930 indicates a section of wheel 910 that is part of the lighted or indicated set of sections, the gaming system provides the bonus opportunity associated with the sections of that indicated set to the player.

Figure 14:
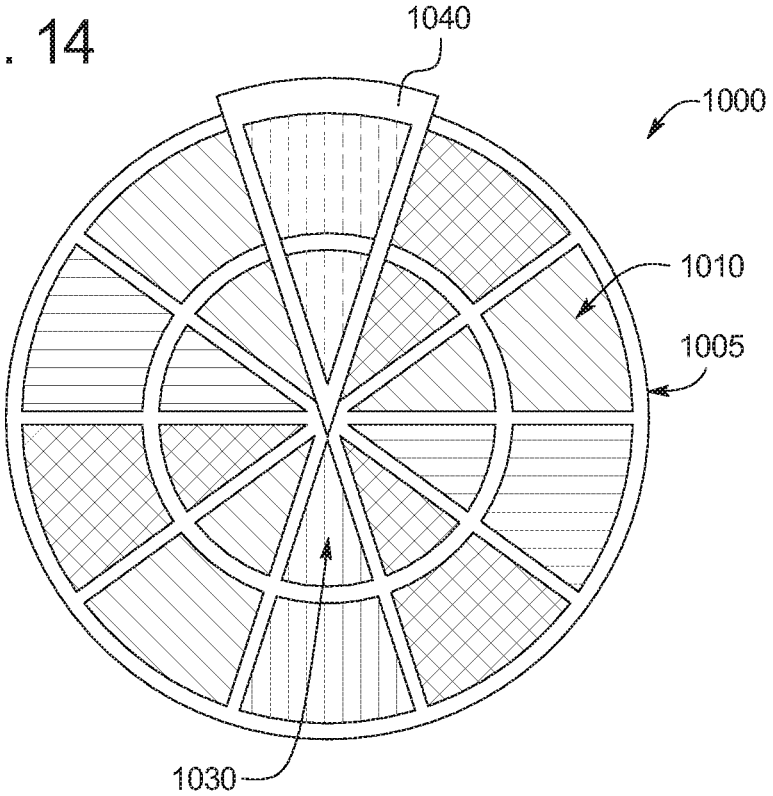
FIG. 14 illustrates a screen shot of another alternative embodiment of the element generator.

FIG. 14 illustrates another alternative embodiment of the element generator of the present disclosure. In this embodiment, element generator 1000 includes a wheel 1005 having an outer concentric wheel portion 1010 and an inner concentric wheel portion 1030. Each of outer concentric wheel portion 1010 and inner concentric wheel portion 1030 includes a plurality of sections (i.e., elements). Each of the sections is associated with one of a plurality of different colors (i.e., characteristics). Element generator 1000 also includes a section indicator 1040 configured to simultaneously indicate one section of each of the concentric wheel portions of wheel 1005 following a spin of the concentric wheel portions. In this example, upon an occurrence of the secondary matching game triggering event, the gaming system randomly determines one of the sections of each of the concentric wheel portions by independently spinning and stopping each of the concentric wheel portions such that section indicator 1040 indicates one section of each concentric wheel portion. Further, in this example, the gaming system changes the color of one or more of the sections while the concentric wheel portions are spinning. When the randomly determined sections are each associated with a same color, the gaming system provides a bonus opportunity that, in certain embodiments, is based on that color. In other embodiments, the gaming system does not spin the concentric wheel portions, and instead changes the color of one or more of the sections of the concentric wheel portions.

Figure 15:
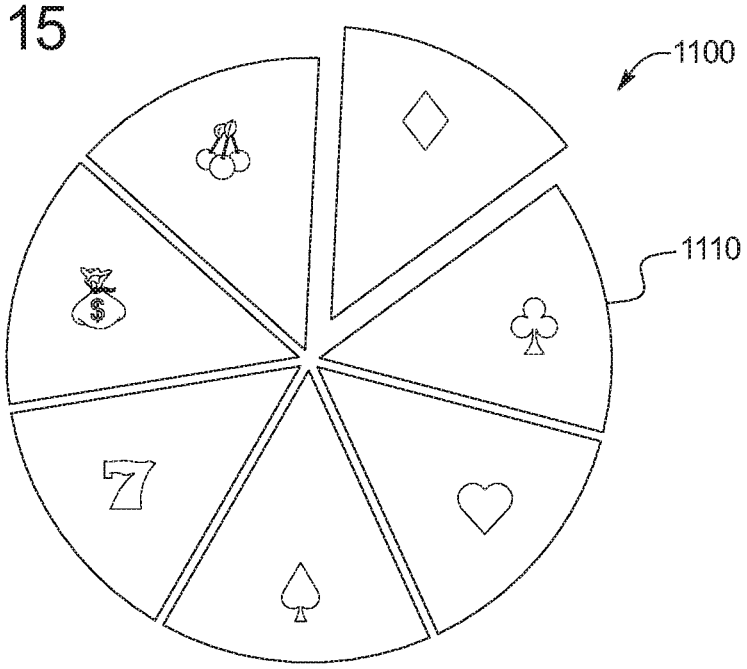
FIG. 15 illustrates a screen shot of another alternative embodiment of the element generator.

FIG. 15 illustrates another alternative embodiment of the element generator of the present disclosure. In this embodiment, element generator 1100 includes a wheel 1110, which includes a plurality of sections (i.e., elements), and an indicator (not shown) configured to indicate one of the sections. In this embodiment, each of the sections is associated with one of a plurality of symbols (i.e., characteristics) instead of colors. Upon an occurrence of the secondary matching game triggering event, the gaming system randomly determines one of the sections by spinning and stopping the wheel such that the indicator indicates one of the sections. The gaming system determines any bonus opportunities based on the symbol associated with the indicated section, and provides any determined bonus opportunities.

Figure 16:
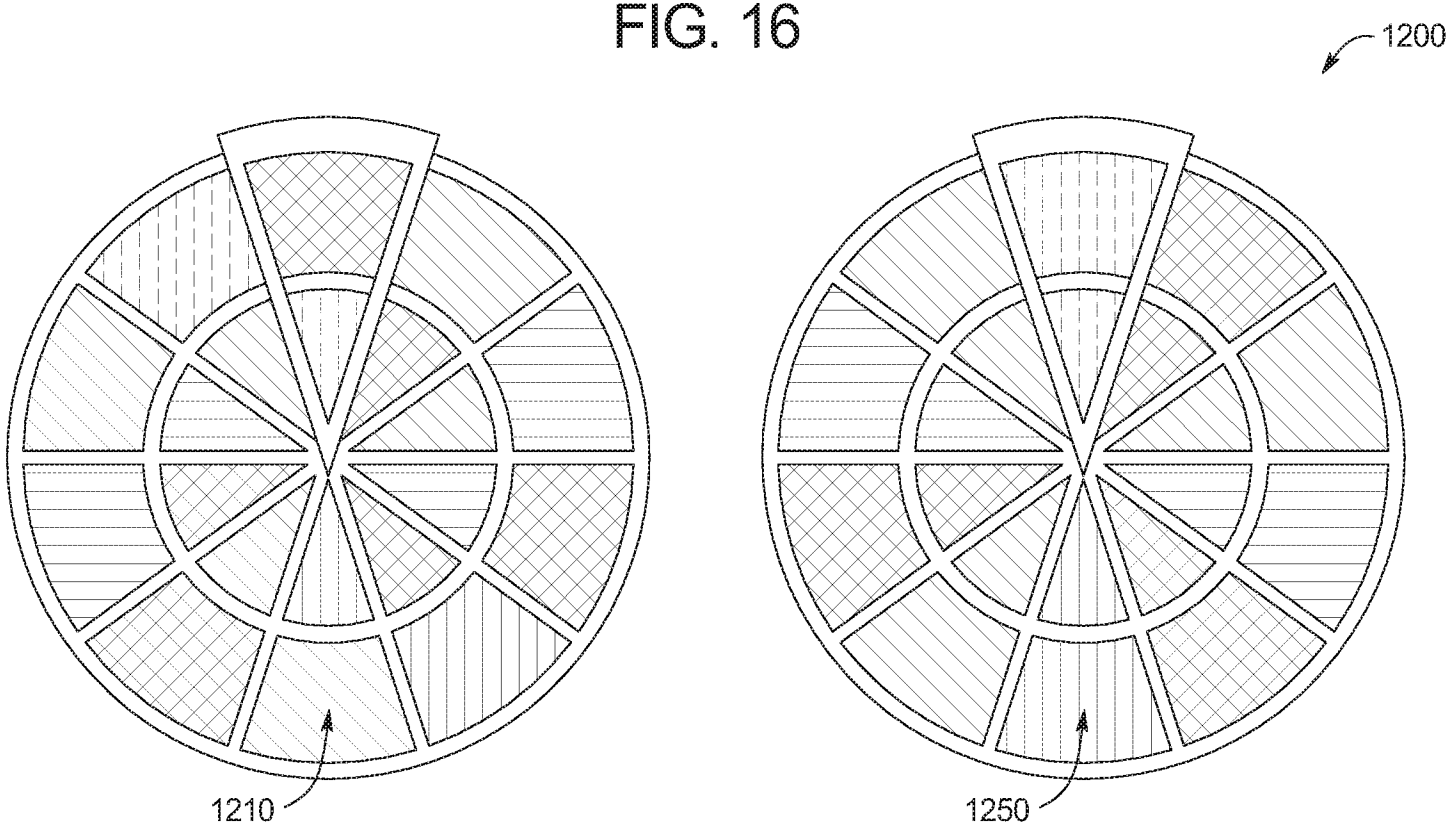
FIG. 16 illustrates a screen shot of another alternative embodiment of the element generator.

FIG. 16 illustrates another alternative embodiment of the element generator of the present disclosure. In this embodiment, element generator 1200 includes a plurality of wheels 1210 and 1250 that are similar to those illustrated in FIGS. 2 to 6 and described above and/or those illustrated in FIG. 14 and described above. In this embodiment, upon an occurrence of the secondary matching game triggering event, at a first point in time the gaming system randomly determines a plurality of the sections (i.e., elements) on wheel 1210 and determines whether a designated relationship exists between those randomly determined sections. If so, the gaming system determines a bonus opportunity. At a second point in time, the gaming system randomly determines a plurality of the sections on wheel 1250 and determines whether a designated relationship exists between those randomly determined sections. If so, the gaming system provides the previously-determined bonus opportunity. If not, the gaming system does not provide the previously-determined bonus opportunity.

In another example, as noted above, upon the occurrence of the secondary matching game triggering event, at the first point in time the gaming system randomly determines one of the sections of one of the concentric wheel portions. At the second point in time the gaming system randomly determines one of the sections of each remaining concentric wheel portion. It should be appreciated that at the first point in time the player is aware of the potential bonus opportunity that may be associated with the play of the primary game (i.e., the player is aware of the bonus opportunity associated with the selected section of the wheel). This two step process thus creates anticipation and excitement for the player.

Figure 17:
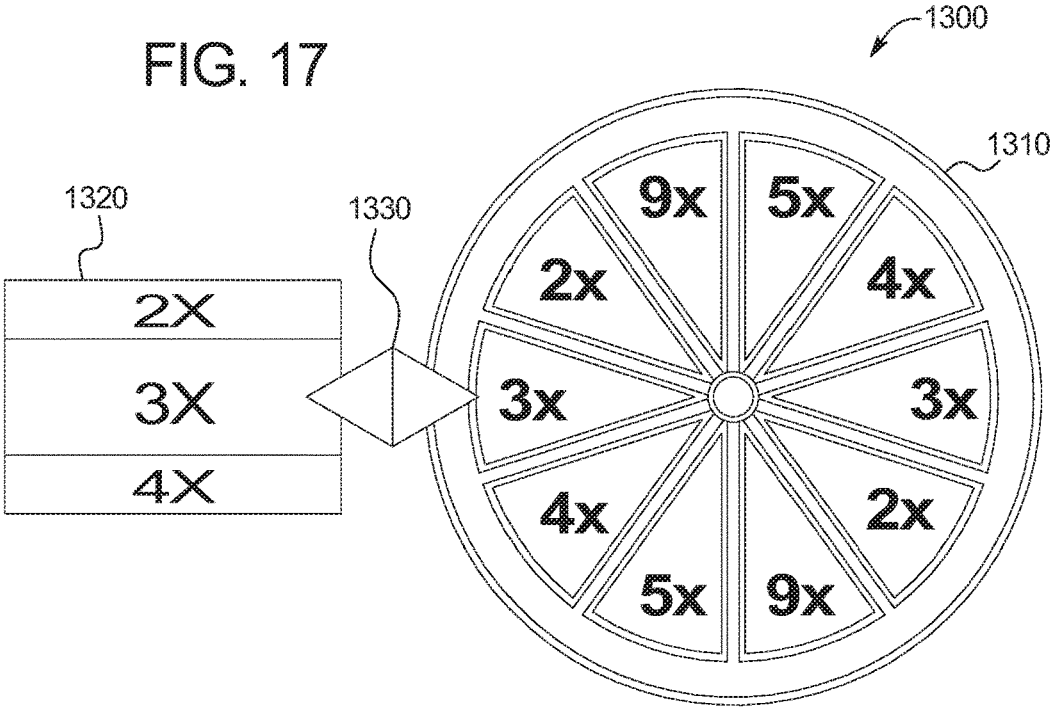
FIG. 17 illustrates a screen shot of another alternative embodiment of the element generator.

FIG. 17 illustrates another alternative embodiment of the element generator of the present disclosure. In this embodiment, element generator 1300 includes a wheel 1310 and a reel or edge-on wheel 1320, each of which includes a plurality of sections (i.e., elements), and an indicator 1330 configured to simultaneously indicate one of the sections of each of wheel 1310 and reel 1320. In this illustrated embodiment, each of the sections is associated with one of a plurality of different bonus opportunities (multipliers in this example). Upon an occurrence of the secondary matching game triggering event, the gaming system randomly determines one of the sections of each of wheel 1310 and reel 1320 by spinning and stopping wheel 1310 and reel 1320 such that indicator 1330 indicates one of the sections on each of wheel 1310 and reel 1320. When the indicated sections are each associated with a same one of the bonus opportunities, the gaming system provides that bonus opportunity to the player.

Figure 18:
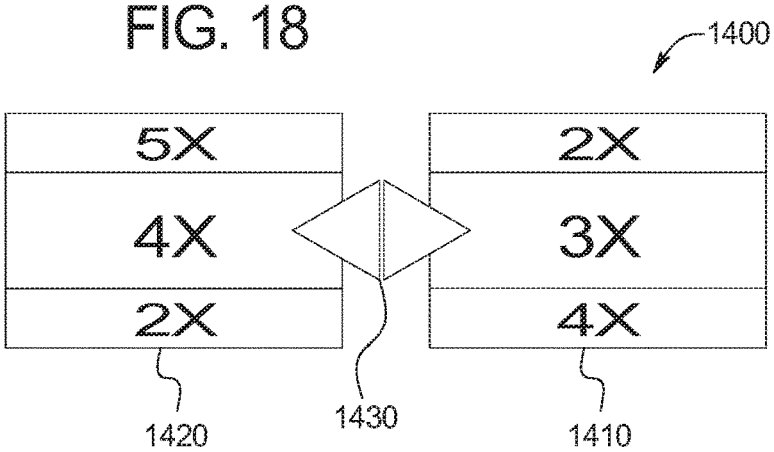
FIG. 18 illustrates a screen shot of another alternative embodiment of the element generator.

FIG. 18 illustrates another alternative embodiment of the element generator of the present disclosure. In this embodiment, element generator 1400 includes reels or edge-on wheels 1410 and 1420, each of which includes a plurality of sections (i.e., elements), and an indicator 1430 configured to simultaneously indicate one of the sections of each of reels 1410 and 1420. In this illustrated embodiment, each of the sections is associated with one of a plurality of different bonus opportunities (multipliers in this example). Upon an occurrence of the secondary matching game triggering event, the gaming system randomly determines one of the sections of each of the reels by spinning and stopping the reels such that indicator 1430 indicates one of the sections on each of the reels. When the indicated sections are each associated with a same one of the bonus opportunities, the gaming system provides that bonus opportunity to the player.

Figure 19:
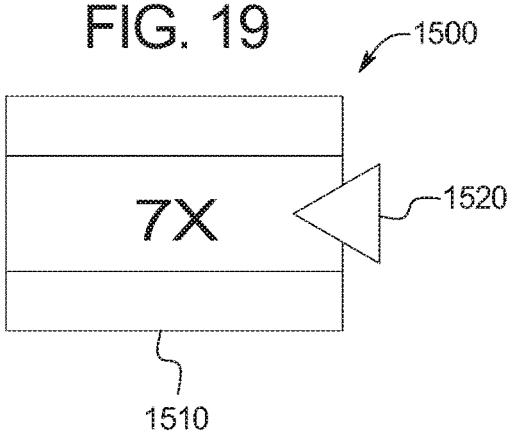
FIG. 19 illustrates a screen shot of another alternative embodiment of the element generator.

FIG. 19 illustrates another alternative embodiment of the element generator of the present disclosure. In this embodiment, element generator 1500 includes a reel or edge-on wheel 1510, which includes a plurality of sections (i.e., elements), and an indicator 1520. In this illustrated embodiment, at least one of, but less than all of, the sections of reel 1510 are each associated with one of a plurality of different bonus opportunities (multipliers in this example), though it should be appreciated that in other embodiments each of the sections of the reel is associated with one of the bonus opportunities. Upon an occurrence of the secondary matching game triggering event, the gaming system randomly determines one of the sections of reel 1510 by spinning and stopping reel 1510 such that indicator 1520 indicates one of the sections. If the indicated section is associated with one of the bonus opportunities, the gaming system provides that bonus opportunity to the player.

In other embodiments, the plurality of elements of the secondary matching game are associated with or otherwise represent a plurality of different cards. In one such embodiment, each of the cards includes or is associated with one of a plurality of different colors. The colors of the cards are associated with or otherwise represent the different characteristics or attributes. In this embodiment, upon an occurrence of a secondary matching game triggering event, the gaming system randomly selects a plurality of the cards. In this embodiment, the gaming system determines whether the designated relationship exists between the randomly selected cards (i.e., the randomly selected elements) by determining whether the randomly selected cards are each associated with the same color (or each belong to the same group or set of colors).

If the randomly selected cards are each associated with the same color (or the same group or set of colors), the gaming system determines which of the bonus opportunities to provide to the player based on that color (or that group or set of colors). That is, in these embodiments, each color (or each group or set of colors) is associated with one of the bonus opportunities, and the color or group or set of colors) associated with the plurality of randomly generated cards having the designated relationship (i.e., sharing the same color or group or set of colors) determines which bonus opportunity to provide to the player. For example, if the gaming system determines that the randomly selected cards are each associated with the color yellow, the gaming system determines and provides the player a play of a first bonus game (i.e., a bonus opportunity) that is associated with the color yellow. Further, in this example, if the gaming system determines that the randomly selected cards are each associated with the color green, the gaming system determines and provides the player a play of a second different bonus game (i.e., a bonus opportunity) that is associated with the color green.

FIGS. 20, 21, 22, and 23 illustrate an example of one such embodiment of the gaming system of the present disclosure. In this example, the gaming system is configured to operate a primary poker game and a secondary matching game. More specifically, the gaming system is configured to display: (a) a play of the primary poker game upon a placement of a primary wager by a player, and (b) a play of the secondary matching game in association with the play of the primary poker game. In one embodiment, the play of the secondary matching game is based upon a placement of a secondary wager by the player in addition to the primary wager. In another embodiment, the play of the secondary matching game occurs without any placement of any secondary wager. For the play of the secondary matching game, the gaming system randomly determines a plurality of elements and determines whether a designated relationship exists between those randomly determined elements. If the designated relationship exists between those randomly determined elements, the gaming system determines and provides a bonus opportunity to the player that is usable or applicable in the play of the primary poker game with which the play of the secondary matching game is associated. In this example, although not shown, play of the primary poker game is generally described above with respect to FIGS. 2 to 6.

Turning to the secondary matching game, in this example, the secondary matching game includes a plurality of secondary game cards (i.e., elements). Each of the secondary game cards is associated with one of a plurality of different colors (i.e., a first characteristic) and one of a plurality of different card families (i.e., a second characteristic). In certain embodiments, one or more of the secondary game cards is a wild card that may or may not be associated with any characteristics. For a play of the secondary matching game in this illustrated example, the gaming system randomly selects a plurality of the secondary game cards. The gaming system subsequently determines whether a designated relationship exists between the randomly selected secondary game cards by determining whether the randomly selected secondary game cards: (a) are each associated with the same color, (b) are each associated with the same card family, or (c) are each associated with the same color and the same card family. If the randomly selected secondary game cards are each associated with the same color, the same card family, or both, the gaming system determines a bonus opportunity associated with that color and/or that card family, and provides the bonus opportunity to the player. If the randomly determined secondary game cards are not each associated with the same color, the same card family, or both, the gaming system does not provide any bonus opportunity to the player. In certain embodiments, certain card families are not associated with colors. In other embodiments, at least two secondary game cards of a same card family are associated with different colors.

Figure 22:
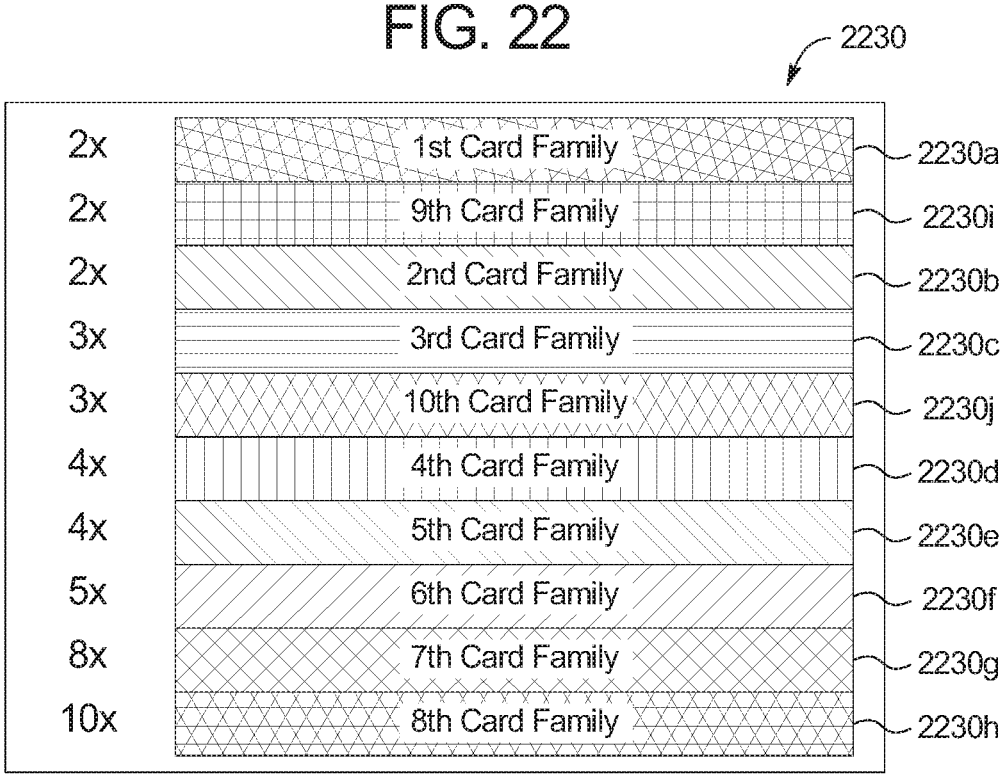
FIG. 22 illustrates an example secondary matching game bonus opportunity table.
Figure 23:
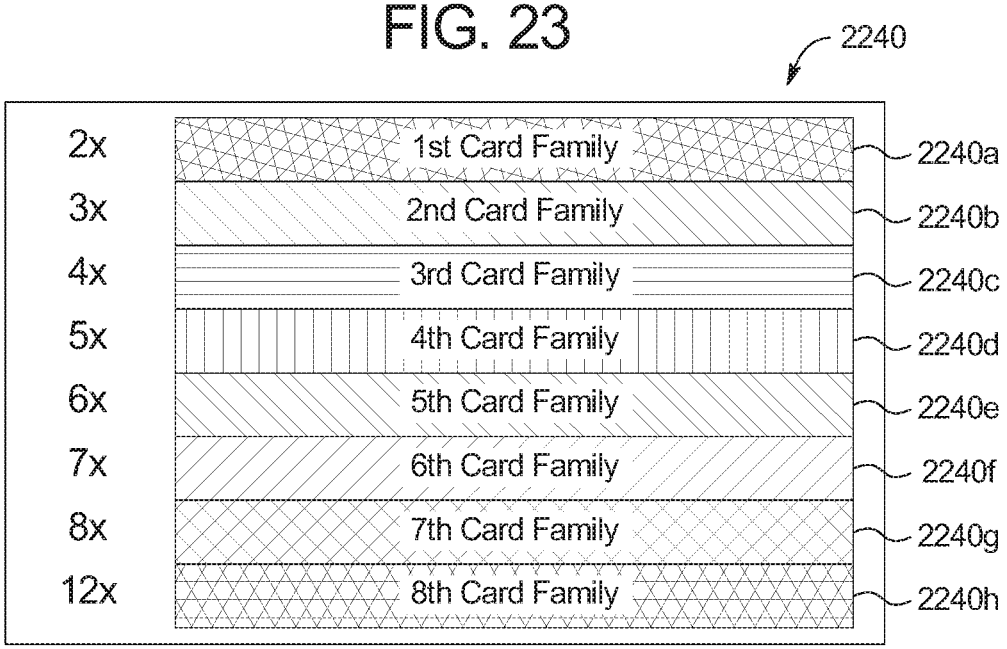
FIG. 23 illustrates another example secondary matching game bonus opportunity table.

In this example, each color and each card family is associated with one of a plurality of different bonus opportunities that are modifiers, such as multipliers, usable in the play of the primary poker game with which a play of the secondary matching game is associated. Specifically, FIGS. 22 and 23 illustrate example secondary matching game bonus opportunity tables 2230 and 2240, respectively, that indicate various bonus opportunities. More particularly, secondary matching game bonus opportunity table 2230 indicates the following bonus opportunities associated with the following colors (represented by patterns) and card families: a 2× multiplier associated with the color purple and a first card family 2230*a*, a 2× multiplier associated with the color light blue and a second card family 2230*b*, a 3× multiplier associated with the color fuchsia and a third card family 2230*c*, a 4× multiplier associated with the color orange and a fourth card family 2230*d*, a 4× multiplier associated with the color red and a fifth card family 2230*e*, a 5× multiplier associated with the color yellow and a sixth card family 2230*f*, an 8× multiplier associated with the color green and a seventh card family 2230*g*, a 10× multiplier associated with the color blue and an eighth card family 2230*h*, a 2× multiplier associated with a ninth card family 2230*i*, and a 3× multiplier associated with a tenth card family 2230*j*. Additionally, secondary matching game bonus opportunity table 2240 indicates the following bonus opportunities associated with the following colors and card families: a 2× multiplier associated with the color purple and a first card family 2240*a*, a 3× multiplier associated with the color light blue and a second card family 2240*b*, a 4× multiplier associated with the color fuchsia and a third card family 2240*c*, a 5× multiplier associated with the color orange and a fourth card family 2240*d*, a 6× multiplier associated with the color red and a fifth card family 2240*e*, a 7× multiplier associated with the color yellow and a sixth card family 2240*f*, an 8× multiplier associated with the color green and a seventh card family 2240*g*, and a 12× multiplier associated with the color blue and an eighth card family 2240*h*. In various embodiments, the gaming system determines which of the secondary matching game bonus opportunity tables to use based on an amount of the secondary wager.

Figure 20:
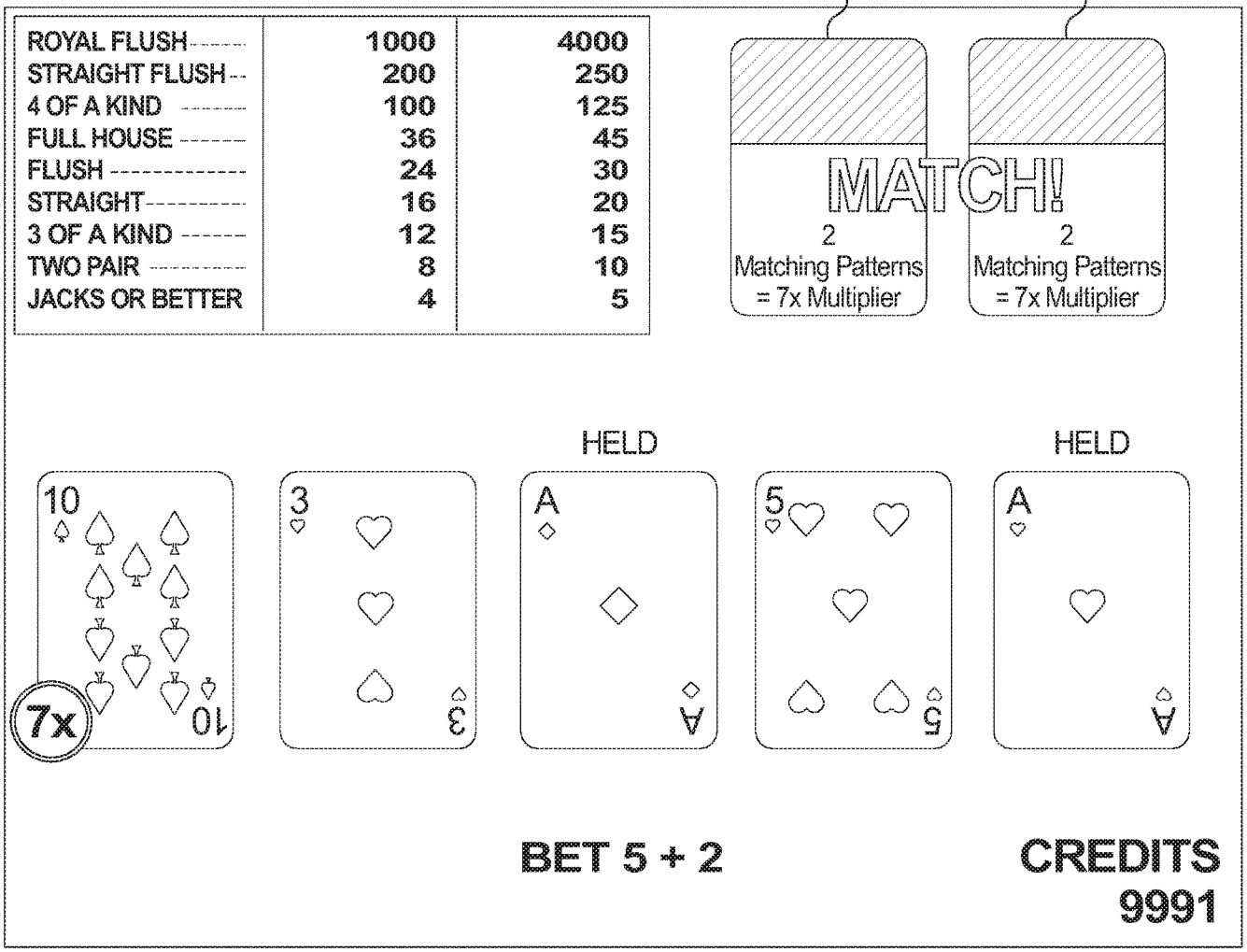
FIG. 20 illustrates a screen shot of another example embodiment of the gaming system of the present disclosure configured to operate a secondary matching game.

In the example illustrated in FIG. 20, the gaming system employs bonus opportunity table 2240. Here, the gaming system receives a primary wager of 5 credits from a player for a play of the primary poker game and a secondary wager of 2 credits from the player to activate the secondary matching game in association with the play of the primary poker game. It should be appreciated that, in this example, the gaming system enables the player to place the secondary wager to activate the secondary matching game only if the player places the maximum primary wager of 5 credits. It should be appreciated that, in other embodiments, the gaming system enables the player to place the secondary wager to activate the secondary matching game regardless of an amount of the primary wager.

In this example, after receiving the player's primary and secondary wagers, the gaming system randomly selects and displays an initial player hand for the play of the primary poker game. Additionally, the gaming system randomly selects and displays a first card 2210*a* and a second card 2220*a*. First card 2210*a* is associated with the color yellow and the sixth card family 2240*f*. Second card 2220*a* is also associated with the color yellow and the sixth card family 2240*f*. The gaming system determines that first card 2210*a* and second card 2220*a* are each associated with the same color (i.e., yellow) and the same card family (i.e., the sixth card family 2240*f*). Accordingly, in this illustrated example, the gaming system provides the player the 7× multiplier associated with the color yellow and the sixth card family 2240*f*, as indicated by secondary matching game bonus opportunity table 2240. Accordingly, the gaming system activates the 7× multiplier for the play of the primary poker game associated with the play of the secondary matching game.

Figure 21:
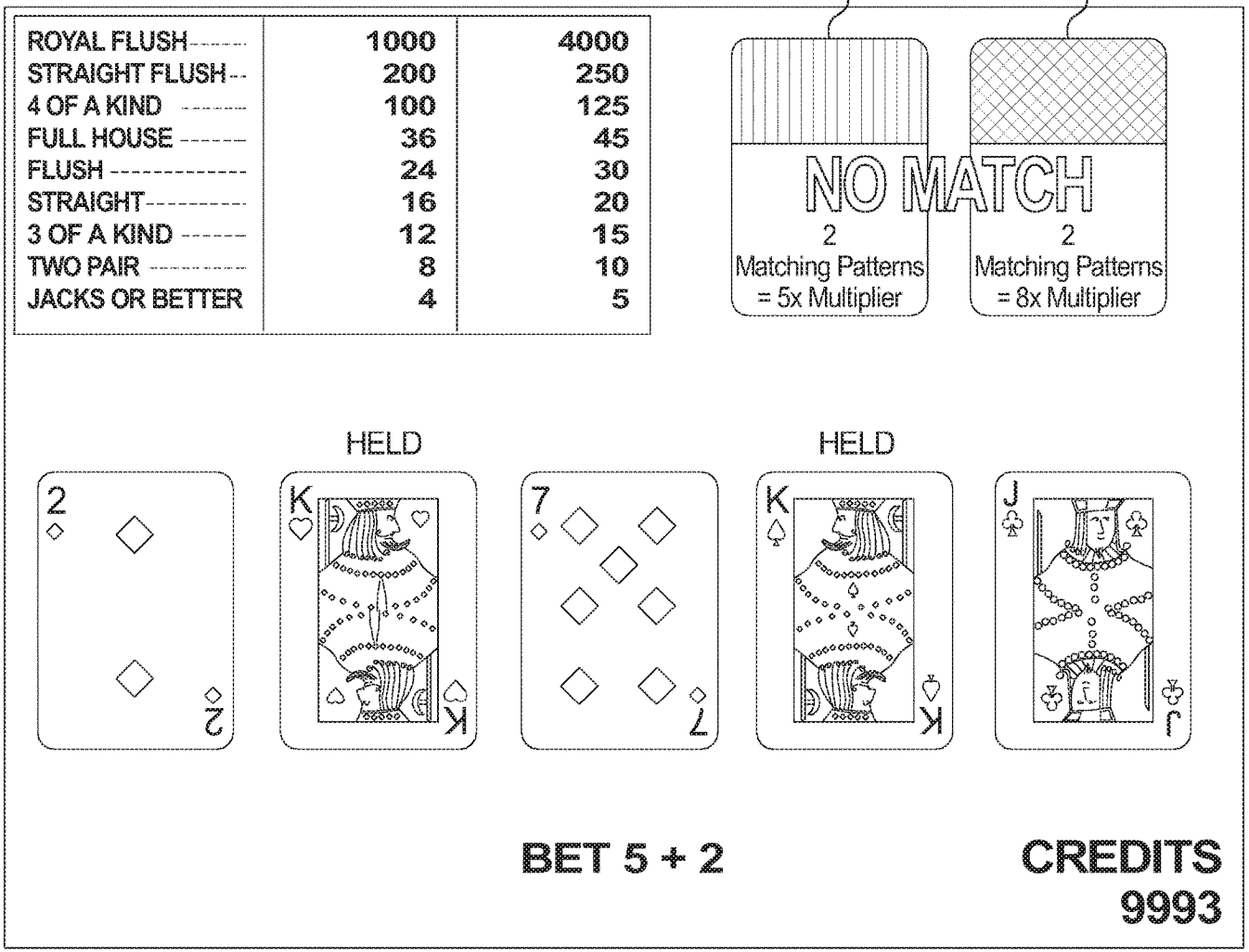
FIG. 21 illustrates a screen shot of another example embodiment of the gaming system of the present disclosure configured to operate a secondary matching game.

In the example illustrated in FIG. 21, the gaming system receives a primary wager of 5 credits from a player for a play of the primary poker game and a secondary wager of 2 credits from the player to activate the secondary matching game in association with the play of the primary poker game. In this example, after receiving the player's primary and secondary wagers, the gaming system randomly selects and displays an initial player hand for the play of the primary poker game. Additionally, the gaming system randomly selects and displays a first card 2210*b* and a second card 2220*b*. First card 2210*b* is associated with the color orange and the fourth card family 2240*d*. Second card 2220*b* is associated with the color green and the seventh card family 2240*g*. The gaming system determine that first card 2210*b* and second card 2220*b* are not each associated with the same color or the same card family. Accordingly, in this illustrated example, the gaming system does not provide the player with any bonus opportunity.

In certain embodiments, the gaming system is configured to operate a primary wagering game and a secondary game, such as a secondary trail game. The secondary trail game includes a plurality of elements or components, such as a plurality of positions of a trail or path. Each of the positions is associated with one of a plurality of different bonus opportunities, such as an increased award opportunity or at least one play of at least one bonus game. Upon an occurrence of a secondary trail game triggering event, the gaming system randomly determines a plurality of the positions, such as by randomly selecting one or more cards that are each associated with one of the positions. Additionally, the gaming system randomly determines a plurality or quantity of moves of a player symbol on the trail or path, such as by simulating a roll of one or more dice.

Following such multiple random determinations, the gaming system displays a player symbol at an initial one of the positions and moves the player symbol the randomly determined number of player symbol moves from the initial position to a final one of the positions. If the final position is one of the randomly determined positions (i.e., if the player symbol's randomly determined final position is one of the randomly determined positions), the gaming system provides the player the bonus opportunity associated with the final position. In these embodiments, certain of the bonus opportunities are more lucrative, valuable, or advantageous than others. For example, if the gaming system randomly determines a first position and the final one of the positions is the first position, the gaming system provides the player a first modifier for a play of the primary game. Further, in this example, if the gaming system randomly determines a second position and the final one of the positions is the second position, the gaming system provides the player a second different modifier for a play of the primary game.

Figure 24:
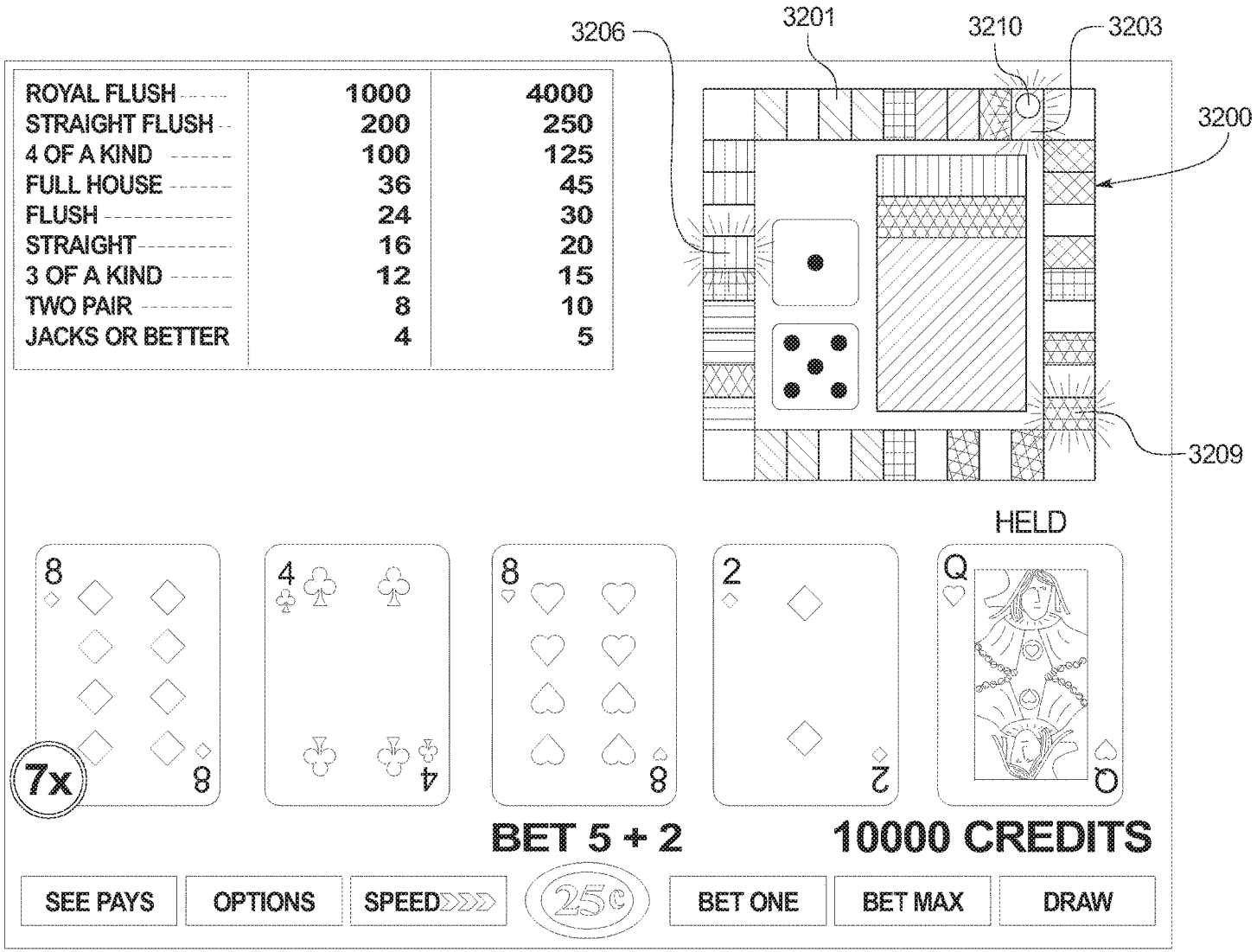
FIG. 24 illustrates a screen shot of an example embodiment of the gaming system of the present disclosure configured to operate a secondary trail game.
Figure 25:
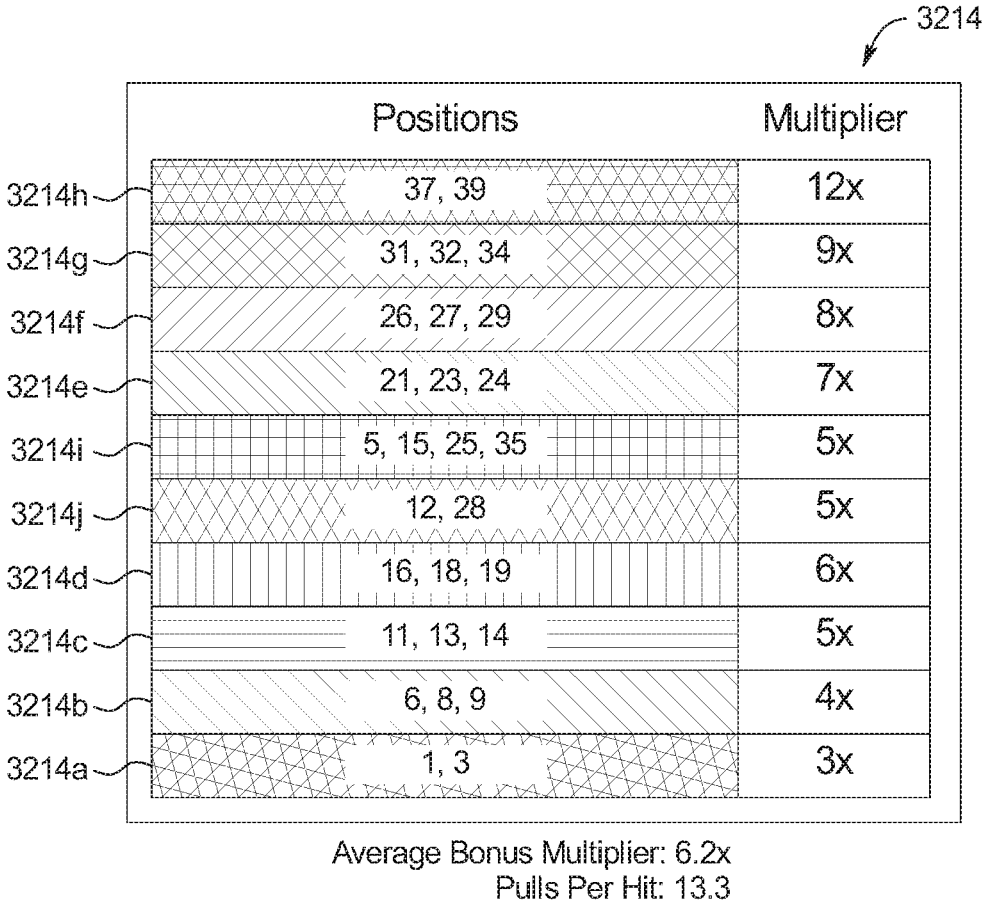
FIG. 25 illustrates an example secondary trail game bonus opportunity table.

FIGS. 24 and 25 illustrate an example of one such embodiment of the gaming system of the present disclosure. In this example, the gaming system is configured to operate a primary poker game and a secondary trail game. More specifically, the gaming system is configured to display: (a) a play of the primary poker game upon placement of a primary wager by a player, and (b) a play of the secondary trail game in association with the play of the primary poker game. In one embodiment, the play of the secondary matching game is based upon a placement of a secondary wager by the player in addition to the primary wager. In another embodiment, the play of the secondary matching game occurs without any placement of any secondary wager.

Turning to the secondary trail game, in this example, the gaming system displays a trail or path 3200 including a plurality of elements or positions. In this illustrated example, each of a plurality of, but less than all of, the positions is associated with one of a plurality of different bonus opportunities. Specifically, FIG. 25 illustrates a secondary trail game bonus opportunity table 3214 that indicates the following bonus opportunities are associated with the following positions: a 3× multiplier associated with two of the positions (Position 1 and Position 3); a 4× multiplier associated with three of the positions (Position 6, Position 8, and Position 9); a 5× multiplier associated with three of the positions (Position 11, Position 13, and Position 14); a 6× multiplier associated with three of the positions (Position 16, Position 18, and Position 19); a 5× multiplier associated with two of the positions (Position 12 and Position 28); a 5× multiplier associated with four of the positions (Position 5, Position 15, Position 25, and Position 35); a 7× multiplier associated with three of the positions (Position 21, Position 23, and Position 24); an 8× multiplier associated with three of the positions (Position 26, Position 27, and Position 29); a 9× multiplier associated with three of the positions (Position 31, Position 32, and Position 34); and a 12× multiplier associated with two of the positions (Position 37 and Position 39).

In this illustrated example, for a play of the secondary trail game, the gaming system randomly determines three of the positions and randomly determines a number of player symbol moves by simulating a roll of two dice. It should be appreciated that the gaming system may randomly determine any suitable quantity of the positions and determine the number of player symbol moves in any suitable manner. Following these plurality of random determinations, the gaming system displays a player symbol at an initial one of the positions and moves the player symbol the randomly determined number of player symbol moves from the initial one of the positions to a final one of the positions. If the final one of the positions is one of the randomly determined positions, the gaming system provides the player the bonus opportunity associated with that randomly determined position. In this example, although not shown, play of the primary poker game is generally described above with respect to FIGS. 2 to 6.

In this illustrated example, as shown in FIG. 24, the gaming system receives a primary wager of 5 credits from a player for a play of the primary poker game and a secondary wager of 2 credits from the player to activate the secondary trail game in association with the play of the primary poker game. It should be appreciated that, in this example, the gaming system enables the player to place the secondary wager to activate the secondary trail game only if the player places the maximum primary wager of 5 credits. It should be appreciated that, in other embodiments, the gaming system enables the player to place the secondary wager to activate the secondary trail game regardless of an amount of the primary wager.

In this example, after receiving the plyer's primary and secondary wagers, the gaming system randomly selects and displays an initial player hand for the play of the primary poker game. Additionally, the gaming system randomly selects the following three positions for the play of the secondary trail game: a first position 3203 (i.e., Position 29); a second position 3206 (i.e. Position 16); and a third position 3209 (i.e., Position 39). In this example, as indicated by secondary trail game bonus opportunity table 3214, first position 3203 is associated with a bonus opportunity of an 8× multiplier, second position 3206 is associated with a bonus opportunity of a 6× multiplier, and third position 3209 is associated with a bonus opportunity of a 12× multiplier.

As shown in FIG. 24, the gaming system lights or otherwise indicates first position 3203, second position 3206, and third position 3209. The gaming system simulates a roll of two dice to determine a number of player symbol moves that, in this example, is equal to six moves. The gaming system initially displays a player symbol 3210 at an initial position 3201 (i.e., Position 23). The gaming system displays player symbol 3210 moving six positions (i.e., the randomly determined number of player symbol moves) in a clockwise direction from initial position 3201 to a final position. Since the final position is or matches the same position as first position 3203 (i.e., since the final position is or matches one of the randomly selected positions), the gaming system provides the 8× multiplier (i.e., the bonus opportunity associated with first position 3203) to the player. Accordingly, the gaming system activates the 8× multiplier for the play of the primary poker game associated with the play of the secondary trail game.

In one embodiment, the gaming system randomly determines the positions by randomly selecting a plurality of cards from a deck of cards each associated with one of the positions. In another embodiment, the gaming system randomly determines the positions in a manner not displayed or otherwise indicated to the player (such as via a behind-the-scenes random determination).

In various embodiments, the initial position at which the player symbol is displayed may be: (a) randomly determined, (b) determined based on a simulated roll of one or more dice, (c) determined based on the primary wagering game (such as based on a sub-symbol associated with a slot game symbol or a rank of a first dealt card in a poker game), (d) determined based on the final position at which the player symbol was displayed following a previous play of the secondary trail game, (e) a predetermined position, and/or (f) not based on any position at which the player symbol was displayed during a previous play of the secondary trail game.

In one embodiment, if the simulated roll of the two dice results in each die displaying a same value (e.g., results in each die displaying a "3"), the gaming system simulates an additional roll of the dice. That is, the gaming system rolls the dice a second time, moves the player symbol, and determines whether the final position at which the player symbol is displayed is or matches one of the randomly selected positions. In another embodiment, if a designated quantity of sequential dice rolls each results in the two dice displaying a same one of the values, the gaming system provides a bonus opportunity to the player and ends play of the secondary trail game.

In various embodiments, certain of the positions are designated positions. In such embodiments, regardless of whether the designated positions were randomly selected by the gaming system, the gaming system provides a bonus opportunity to the player if the final position at which the player symbol is displayed is one of the designated positions. In one example, when the final position at which the player symbol is displayed is one of the designated positions, the gaming system automatically moves the player symbol to another position. In another example, when the final position at which the player symbol is displayed is one of the designated positions, the gaming system provides a bonus opportunity to the player regardless of whether that designated position was randomly selected by the gaming system.

In one embodiment, the gaming system randomly selects the positions and simulates the roll of the dice in association with different phases of the primary wagering game. For example, the gaming system randomly selects the positions while dealing the initial player hand of a primary poker game, and simulates the roll of the dice after replacing any discarded cards with replacement cards to form a final player hand for the primary poker game.

Figure 26A:
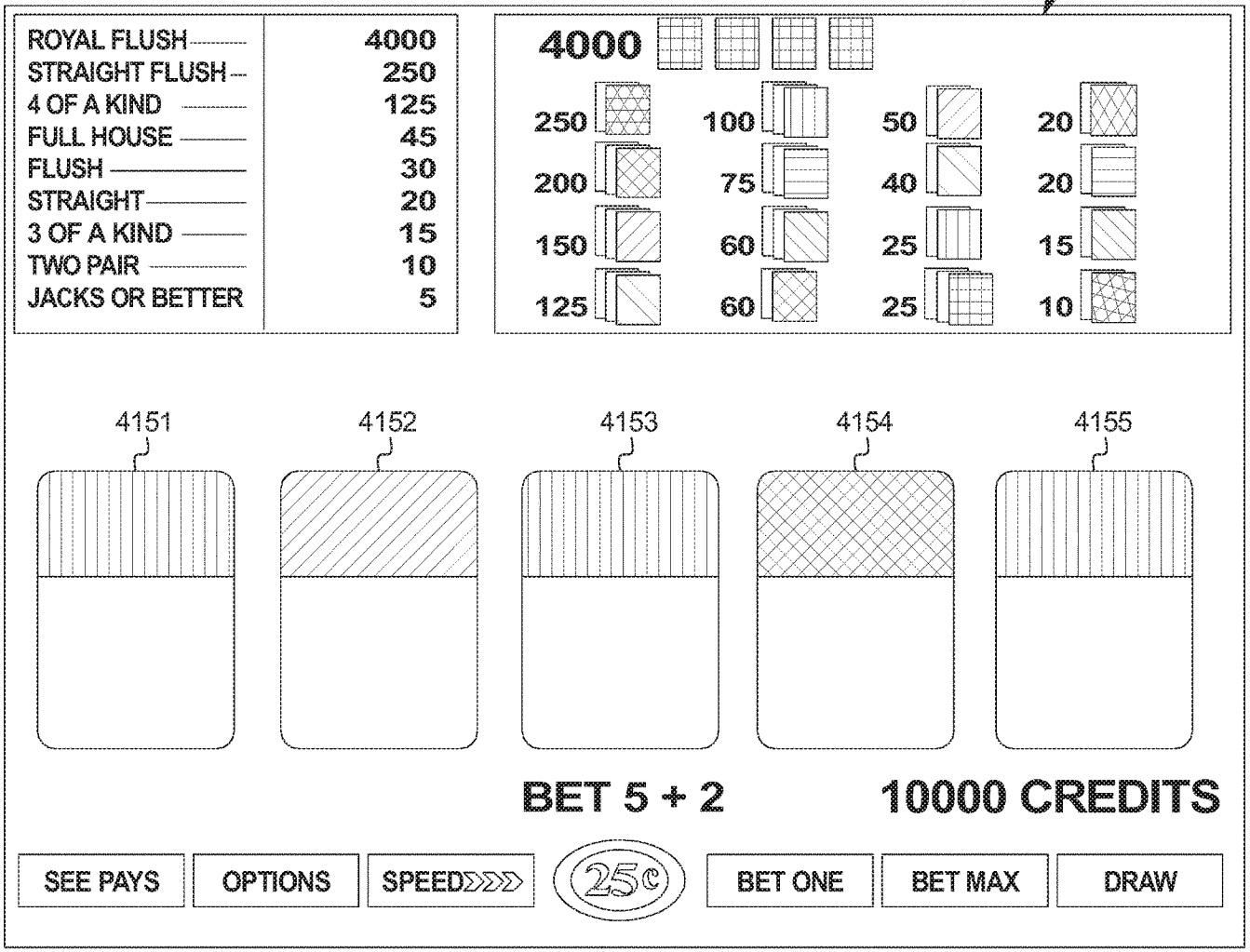
FIGS. 26A, 26B, and 26C illustrate screen shots of another example embodiment of the gaming system of the present disclosure configured to operate a secondary matching game.
Figure 26B:
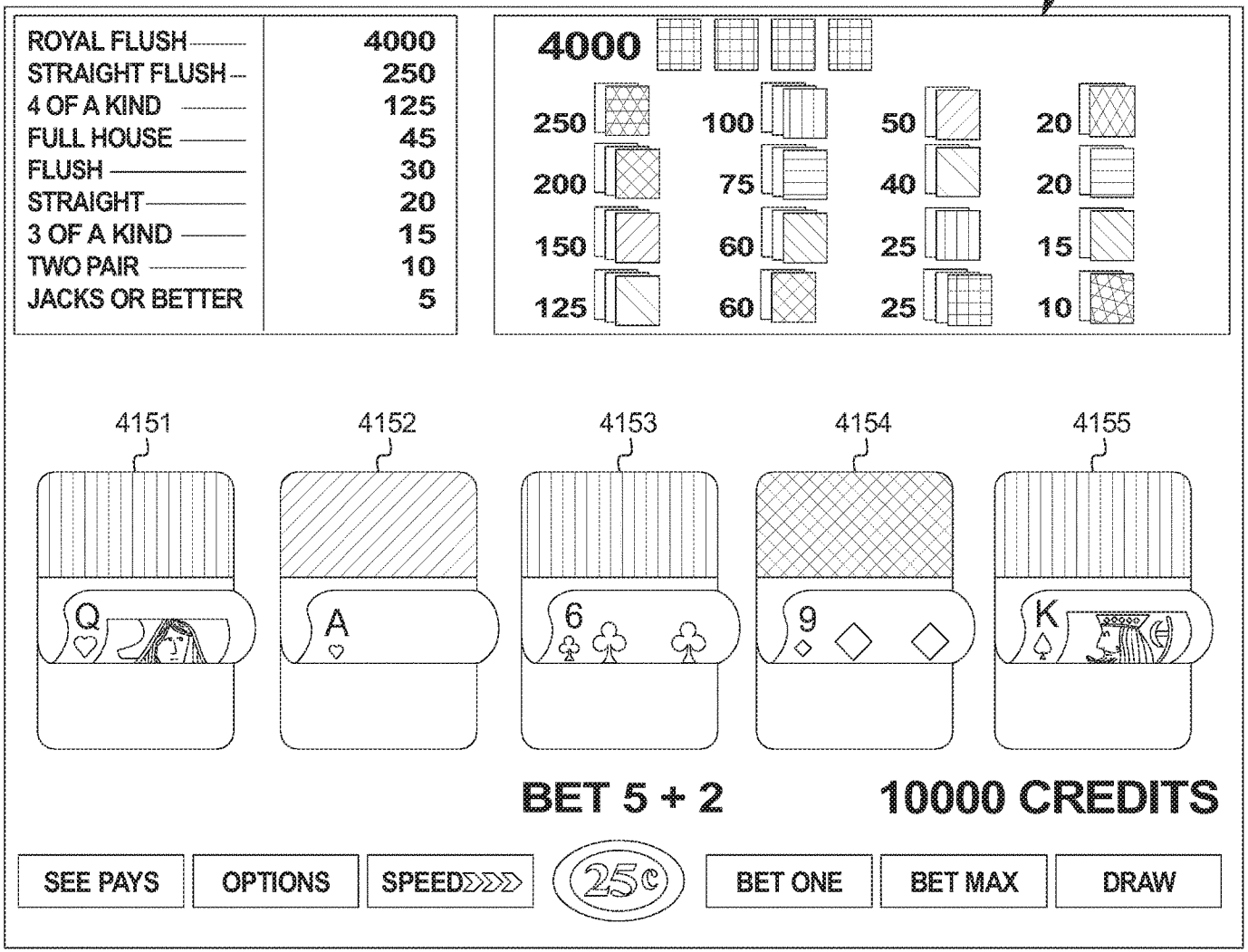
Figure 26C:
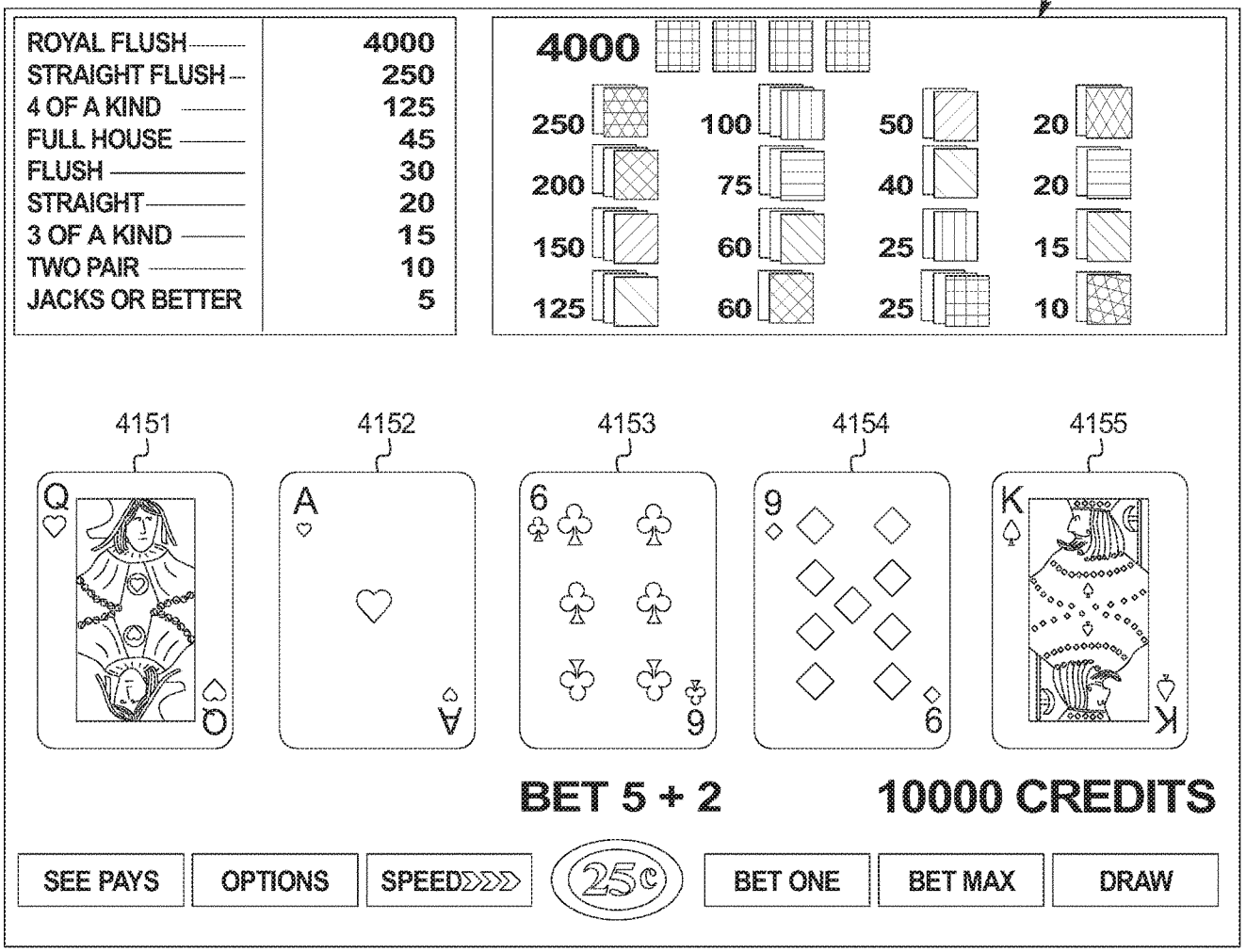

FIGS. 26A, 26B, and 26C illustrate another example embodiment of the gaming system of the present disclosure. In this example, the gaming system is configured to operate a primary poker game and a secondary matching game. More specifically, the gaming system is configured to display: (a) a play of the primary poker game upon placement of a primary wager by a player, and (b) a play of the secondary matching game in association with the play of the primary poker game. In one embodiment, the play of the secondary matching game is based upon a placement of a secondary wager by the player in addition to the primary wager. In another embodiment, the play of the secondary matching game occurs without any placement of any secondary wager.

In this example, the secondary matching game includes a plurality of secondary game cards (i.e., elements), each of which is associated with one of a plurality of different card families (i.e., characteristics) and one of a plurality of playing cards. For a play of the secondary matching game, the gaming system randomly selects a plurality of the secondary game cards. The gaming system determines whether a designated quantity of the randomly selected secondary game cards are each associated with a same one of the card families (i.e., if a plurality of randomly selected elements share a common characteristic). If the gaming system determines that the designated quantity of the randomly selected secondary game cards are each associated with a same one of the card families, the gaming system determines a bonus opportunity associated with that card family and provides the determined bonus opportunity to the player. If the gaming system determines that the designated quantity of randomly selected secondary game cards are not each associated with a same one of the card families, the gaming system does not provide any bonus opportunity to the player. It should be appreciated that in certain embodiments different bonus opportunities associated with different card families require different designated quantities of matching secondary game cards. For example, a first bonus opportunity associated with a first card family requires two matching secondary game cards while a second bonus opportunity associated with a second card family requires three matching secondary game cards.

In the example illustrated in FIG. 26A, for a play of the secondary matching game, the gaming system randomly selects a first secondary game card 4151 associated with a first card family, a second secondary game card 4152 associated with a second card family, a third secondary game card 4153 associated with the first card family, a fourth secondary game card 4154 associated with a third card family, and a fifth secondary game card 4155 associated with the first card family. Each of the secondary game cards is also associated with a playing card (as shown in FIGS. 26B and 26C and as described below). In this illustrated example, the gaming system employs a secondary matching game bonus opportunity table 4240 to determine whether a designated quantity of the secondary game cards is associated with a given card family. Here, the gaming system determines that the designated quantity of three of the randomly selected secondary game cards (the first secondary game card, the third secondary game card, and the fifth secondary game card) are each associated with a same card family (the first card family) and provides the player an award of 100 credits (i.e., a bonus opportunity) associated with the first card family (as indicated by secondary matching game bonus opportunity table 4240). As shown in FIGS. 26B and 26C, the gaming system then enables the player to play the primary poker game using the playing cards associated with the randomly selected secondary game cards.

In another embodiment (not shown), the gaming system first determines any award associated with any matching of the characteristics of the secondary game cards. In this embodiment, after determining any award associated with the matching of any characteristics of the secondary game cards, the gaming system enables the player to either: (a) keep the award and not play the primary poker game, or (b) forfeit the award and play the primary poker game.

In one embodiment, the secondary matching game triggering event and/or the secondary trail game triggering event occurs based on an outcome associated with one or more plays of any primary game and/or an outcome associated with one or more plays of any secondary game of the gaming system. In one such embodiment, such determinations are symbol driven or playing card driven based on the generation of one or more designated symbols, designated symbol combinations, designated playing cards, or designated playing card combinations.

In another embodiment, the gaming system does not provide any apparent reasons to the player for a secondary matching game triggering event and/or the secondary trail game triggering event to occur. In these embodiments, such determinations are not triggered by an event in a primary game or based specifically on any of the plays of any primary game or on any of the plays of any secondary game of the gaming system. That is, such triggering events occur without any explanation or alternatively with simple explanations.

In one embodiment, a secondary matching game triggering event and/or the secondary trail game triggering event occurs based on an amount coin-in. In this embodiment, the gaming system determines if an amount of coin-in wagered at one or more gaming systems reaches or exceeds a designated amount of coin-in (i.e., a threshold coin-in amount). Upon the amount of coin-in wagered at one or more gaming systems reaching or exceeding the bonus threshold coin-in amount, the gaming system causes such a triggering event to occur. In different embodiments, the threshold coin-in amount is predetermined, randomly determined, determined based on a player's status (such as determined through a player tracking system), determined based on a generated symbol or symbol combination, determined based on a random determination by the gaming system, determined based on one or more side wagers placed, determined based on the player's primary game wager, determined based on time (such as the time of day), or determined based on any other suitable method or criteria.

In another embodiment, a secondary matching game triggering event and/or the secondary trail game triggering event occurs based on an amount of coin-out. In this embodiment, the gaming system determines if an amount of coin-out provided by one or more gaming systems reaches or exceeds a designated amount of coin-out (i.e., a threshold coin-out amount). Upon the amount of coin-out provided at one or more gaming systems reaching or exceeding the threshold coin-out amount, the gaming system causes such a triggering event to occur. In different embodiments, the threshold coin-out amount is predetermined, randomly determined, determined based on a player's status (such as determined through a player tracking system), determined based on a generated symbol or symbol combination, determined based on a random determination by the gaming system, determined based on one or more side wagers placed, determined based on the player's primary game wager, determined based on time (such as the time of day), or determined based on any other suitable method or criteria.

In another embodiment, a secondary matching game triggering event and/or the secondary trail game triggering event occurs based on a predefined variable reaching a defined parameter threshold. For example, when the 500,000th player has played a gaming system (ascertained from a player tracking system), the gaming system causes such a triggering event to occur. In different embodiments, the predefined parameter thresholds include a length of time, a length of time after a certain dollar amount is hit, a wager level threshold for a specific gaming system (e.g., which of a plurality of gaming systems is the first to contribute $250,000), a number of gaming systems active, or any other parameter that defines a suitable threshold.

In another embodiment, a secondary matching game triggering event and/or the secondary trail game triggering event occurs based on a quantity of games played. In this embodiment, a quantity of games played is set for when such a triggering event will occur. In one embodiment, such a set quantity of games played is based on historic data.

In another embodiment, a secondary matching game triggering event and/or the secondary trail game triggering event occurs based on time. In this embodiment, a time is set for when such a triggering event will occur. In one embodiment, such a set time is based on historic data.

In another embodiment, a secondary matching game triggering event and/or the secondary trail game triggering event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the gaming system. The gaming system determines the player tracking level of the player and if the current player tracking level defined by the gaming system operator is eligible for such a triggering event. In one embodiment, the gaming system operator defines minimum bet levels required for such a triggering event to occur based on the player's card level.

In another embodiment, a secondary matching game triggering event and/or the secondary trail game triggering event occurs based on a system determination, including one or more random selections by a central controller, central server, or remote host (as further described below). In one embodiment, as described above, the central controller, central server, or remote host tracks all active gaming systems and the wagers placed on those gaming systems. In one such embodiment, based on the gaming system's state as well as one or more wager pools associated with the gaming system, the central controller, central server, or remote host determines whether such a triggering event will occur. In one such embodiment, the player who consistently places a higher wager is more likely to be associated with an occurrence of such a triggering event than a player who consistently places a minimum wager. It should be appreciated that the criteria for determining whether a player is in active status or inactive status for determining if such a triggering event will occur may the same as, substantially the same as, or different than the criteria for determining whether a player is in active status or inactive status for another event to occur.

In another embodiment, a secondary matching game triggering event and/or the secondary trail game triggering event occurs based on a determination of whether any numbers allotted to a gaming system match a randomly selected number. In this embodiment, upon or prior to each play of each gaming system, a gaming system selects a random number from a range of numbers and during each primary game, the gaming system allocates the first N numbers in the range, where N is the number of credits bet by the player in that primary game. At the end of the primary game, the randomly selected number is compared with the numbers allocated to the player and if a match occurs, such a triggering event occurs. It should be appreciated that any suitable manner of causing a progressive award contribution rate reconfiguration event to occur, and/or causing a progressive award triggering event to occur may be implemented in accordance with the gaming system and method disclosed herein.

It should be appreciated that any of the above-described secondary matching game triggering events and/or the secondary trail game triggering events may be combined in one or more different embodiments.

In the examples described above, the bonus opportunities are modifiers, such as multipliers, that are used to modify any award won for a play of the primary wagering game. It should be appreciated that, in different embodiments, one or more of the bonus opportunities include, but are not limited to: a play of any suitable slot game, a play of any suitable free spins or free activations game, a play of any suitable wheel game, a play of any suitable card game, a play of any suitable offer and acceptance game, a play of any suitable award ladder game, a play of any suitable puzzle-type game, a play of any suitable persistence game, a play of any suitable selection game, a play of any suitable cascading symbols game, a play of any suitable ways to win game, a play of any suitable scatter pay game, a play of any suitable coin-pusher game, a play of any suitable elimination game, a play of any suitable stacked wilds game, a play of any suitable trail game, a play of any suitable bingo game, a play of any suitable video scratch-off game, a play of any suitable pick-until-complete game, a play of any suitable shooting simulation game, a play of any suitable racing game, a play of any suitable promotional game, a play of any suitable high-low game, a play of any suitable lottery game, a play of any suitable number selection game, a play of any suitable dice game, a play of any suitable skill game, a play of any suitable auction game, a play of any suitable reverse-auction game, a play of any suitable group game a play of any other suitable type of game, an award of monetary credits or currency, an award of non-monetary credits, an award of player tracking credits or points, an award of a physical prize such as a car, or a comp award such as a free night's stay in a hotel room.

It should be appreciated that any suitable characteristics may be employed. For instance, in various embodiments, each characteristic is: (a) one of a plurality of different colors; (b) one of a plurality of different patterns; (c) one of a plurality of different letters; (d) one of a plurality of different phrases; (e) one of a plurality of different logos; (f) one of a plurality of different playing card suits (such as spades, hearts, clubs, and diamonds); (g) one of a plurality of playing card ranks (such as two through ace); (h) one of a plurality of Mahjong tiles; (i) one of a plurality of different pictures (such as pictures of presidents); (j) one of a plurality of buildings of different sizes (such as shack, bungalow, house, mansion, duplex, apartment building, skyscraper); (k) one of a plurality of fish of different sizes and/or types (such as goldfish, trout, salmon, shark, and whale); (l) one of a plurality of animals of different sizes and/or types (such as Chihuahua, Poodle, Bulldog, Golden Retriever, and St. Bernard); (m) one of a plurality of different sizes (such as small, medium, large, and extra-large); (n) one of a plurality of different numbers of a symbol (such as single bar, double bar, and triple bar); (o) one of a plurality of different orientations (such as pointing left, pointing up, pointing right, and pointing down); (p) one of a plurality of different categories (such as human, animal, and robot); (q) one of a plurality of different borders (such as a black border, a dotted border, a dashed border, and an oval border); (r) one of a plurality of different poses (such as a mug shot, a profile shot, and a full body shot); (s) one of a plurality of different artistic types (such as a photograph, a watercolor painting, and a cartoon); (t) one of a plurality of different genders (such as a man or a woman); (u) one of a plurality of different ages (such as an infant, a child, a teenager, and an adult); (v) one of a plurality of different outfits (such as a bathing suit, a casual outfit, a suit, and a tuxedo); and (w) one of a plurality of different accessories (such as jewelry, a hat, a scarf, and gloves).

It should further be appreciated that:

(a) which primary game is employed;
(b) which secondary game is employed;
(c) which element generator, if any, is employed for the secondary game;
(d) which bonus opportunities are employed;
(e) which characteristics are employed;
(f) how the elements are generated;
(g) the values of the bonus opportunities;
(h) what constitutes a designated relationship;
(i) the timing of the random generation of the elements with respect to play of the primary game;
(j) the secondary game triggering event;
(k) the quantity of sections in each concentric wheel portion;
(l) the distribution of the characteristics within each set of elements (e.g., for each characteristic, how many of the elements are associated with that characteristic); and/or
(m) any other variables or determinations described herein may be: (1) predetermined; (2) randomly determined; (3) randomly determined based on one or more weighted percentages; (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an electronic gaming machine (EGM) configured to operate the primary game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager; (17) determined independent of the player's primary game wager; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to below as an "EGM." Additionally, for brevity and clarity, unless specifically stated otherwise, "EGM" as used below represents one EGM or a plurality of EGMs, and "central server, central controller, or remote host" as used below represents one central server, central controller, or remote host or a plurality of central servers, central controllers, or remote hosts.

Figure 27A:
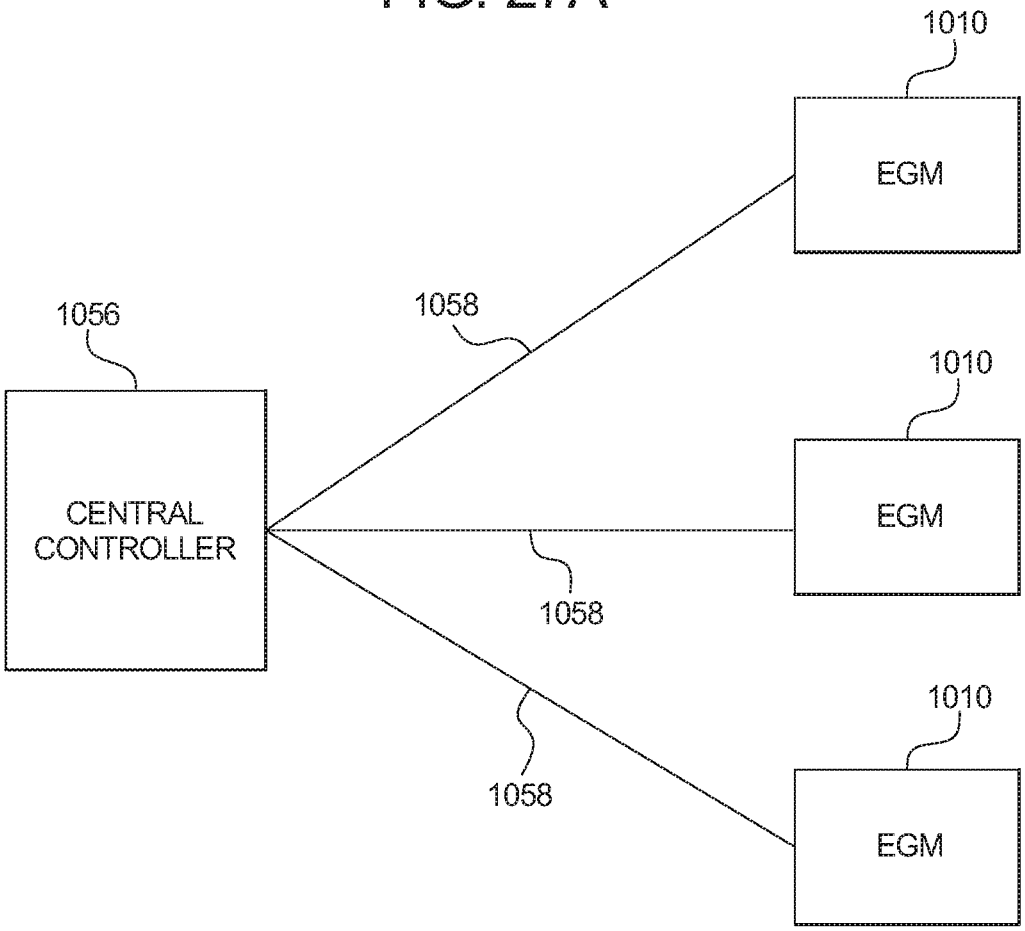
FIG. 27A is a schematic block diagram of an example network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 27A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 27B:
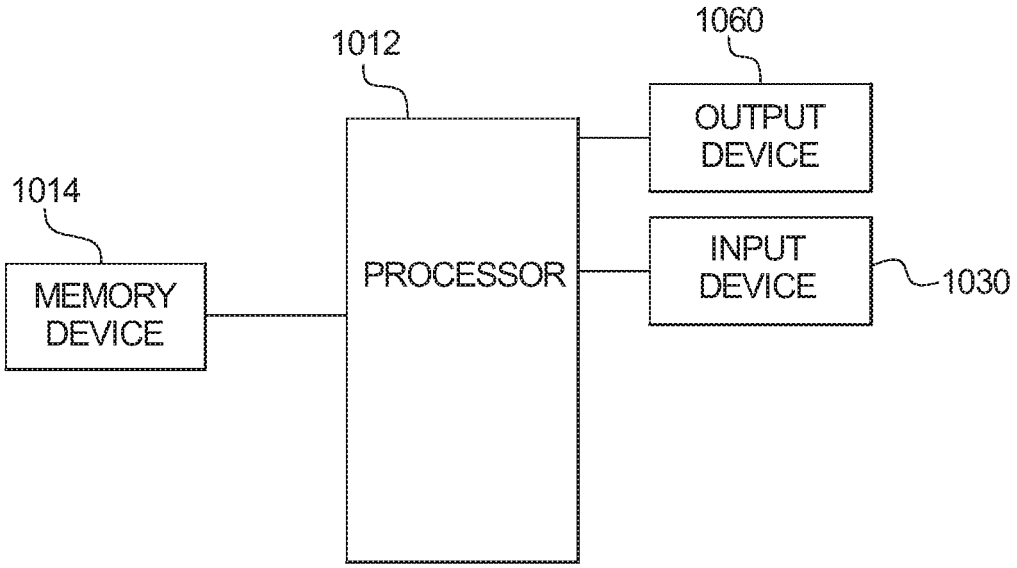
FIG. 27B is a schematic block diagram of an example electronic configuration of the gaming system of the present disclosure.
Figure 28A:
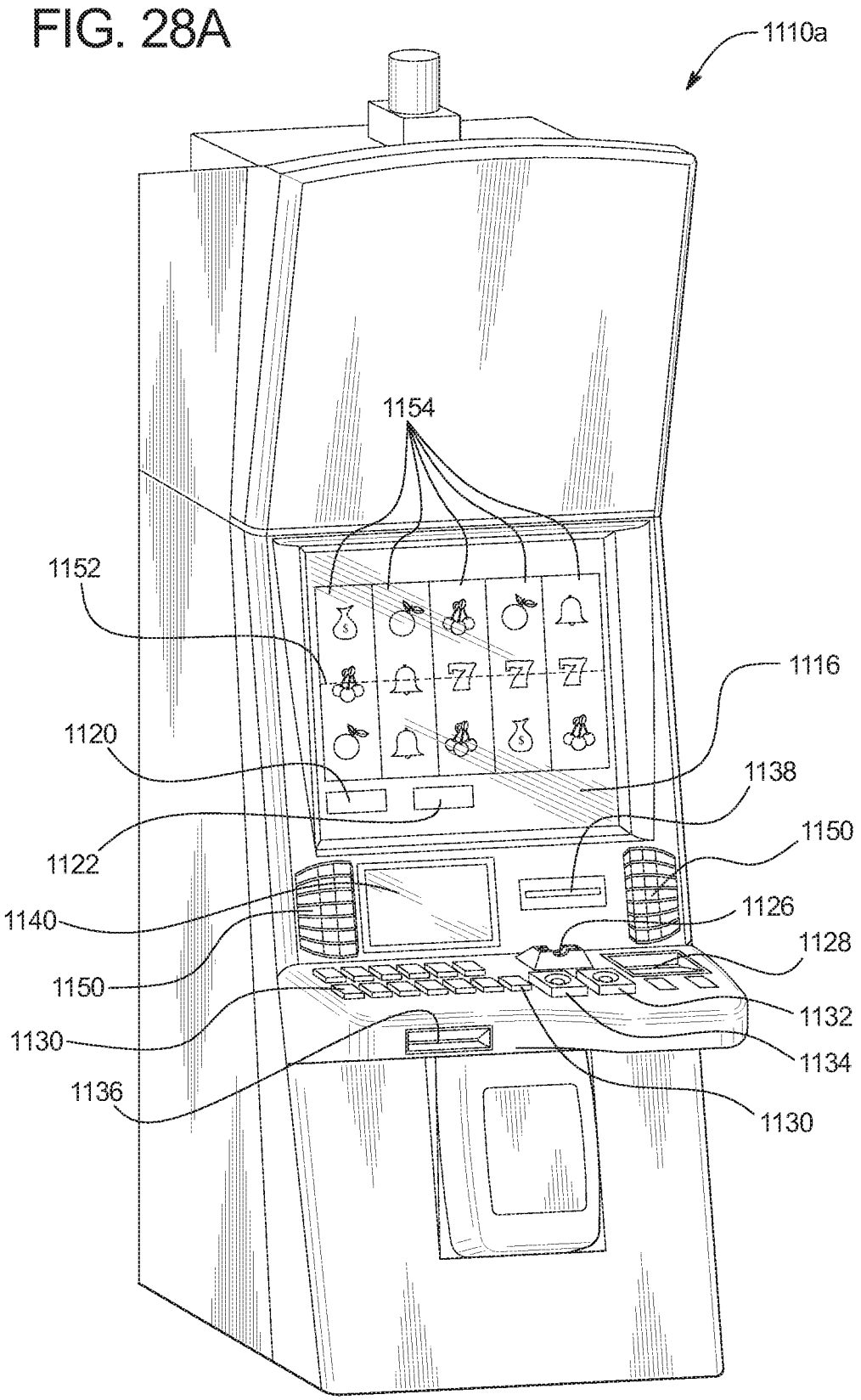
FIGS. 28A, 28B, 28C, and 28D are perspective views of example alternative embodiments of the gaming system of the present disclosure.
Figure 28B:
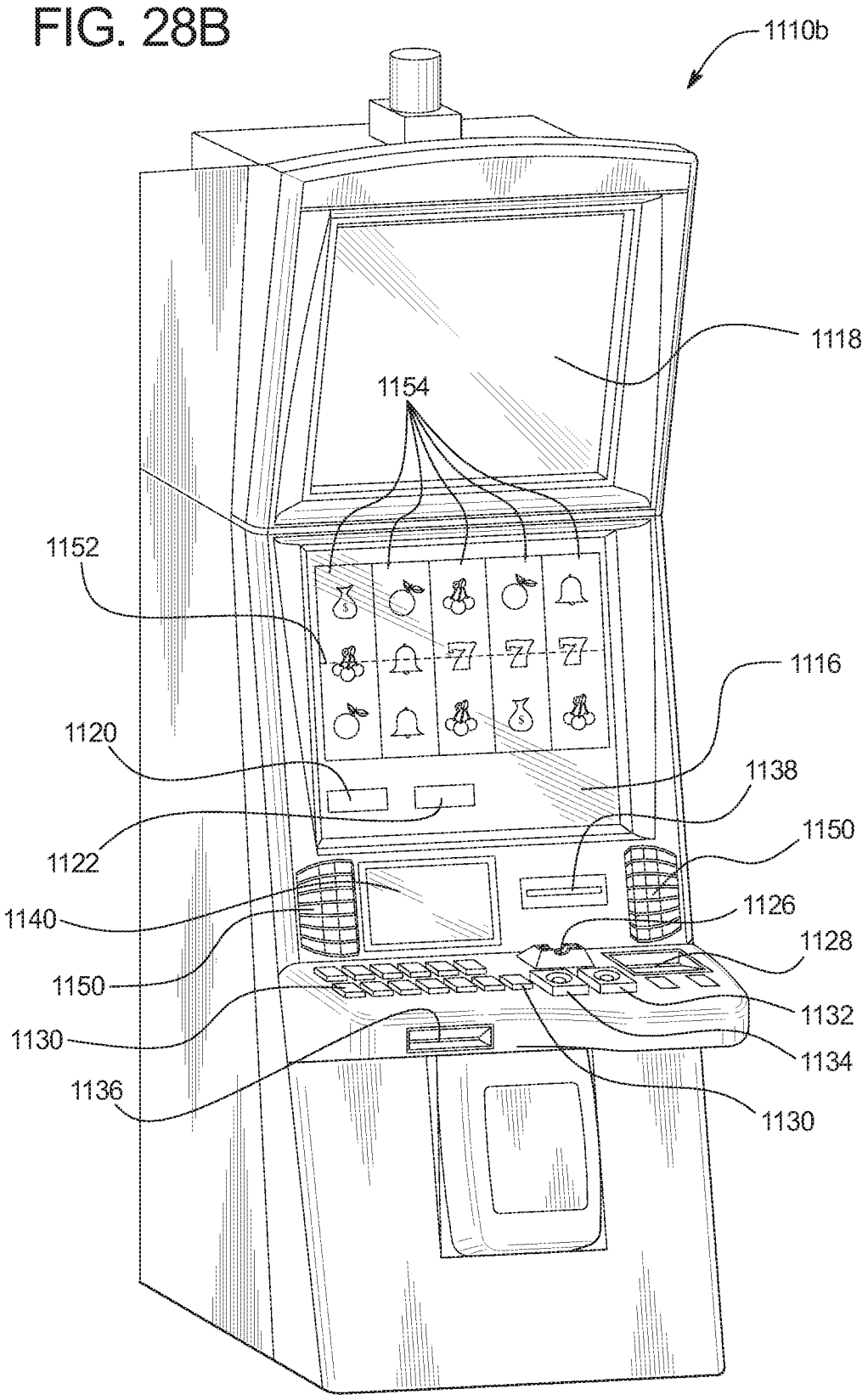
Figure 28C:
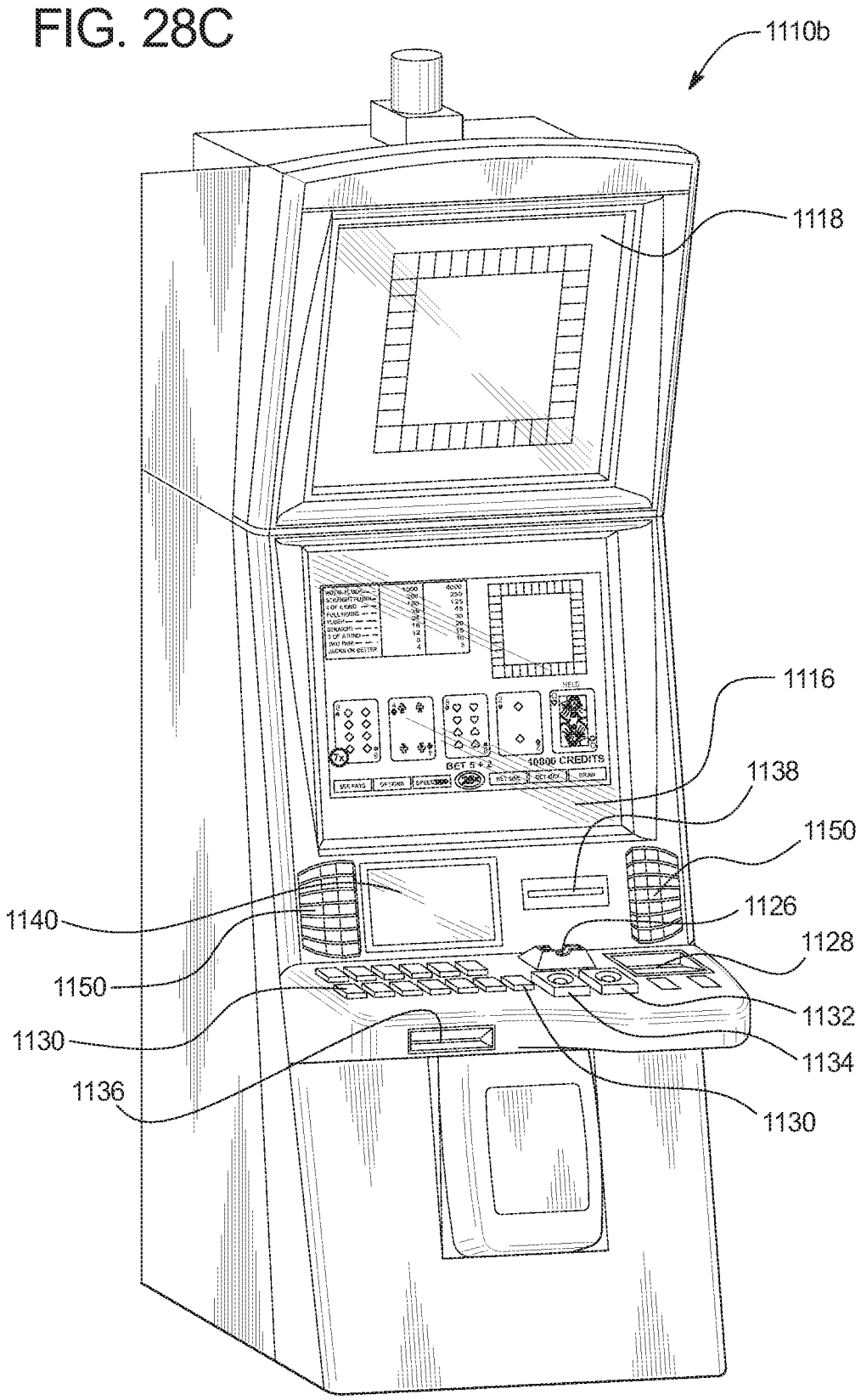
Figure 28D:
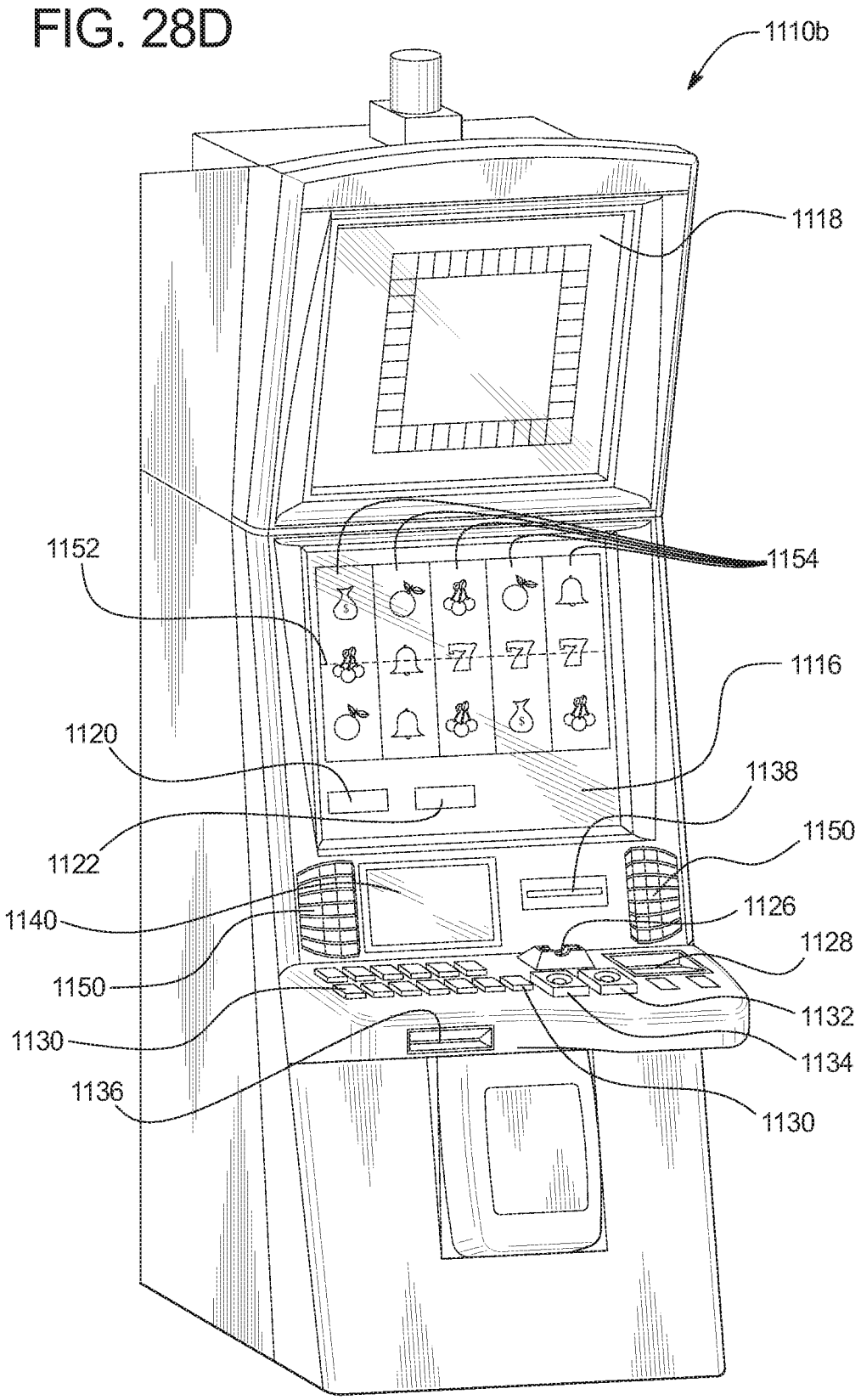

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 27B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 27B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

In various embodiments, the EGM includes one or more input devices. The input devices may include any suitable device that enables an input signal to be produced and received by the at least one processor of the EGM. The example EGM illustrated in FIG. 27B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 28A, 28B, 28C, and 28D illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 28A, 28B, 28C, and 28D each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 28A, 28B, 28C, and 28D each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 28A, 28B, 28C, and 28D each include a card reader 1138. The card reader is configured to read a player identification card inserted into the card reader.

In various embodiments, the EGM includes one or more output devices. The example EGM illustrated in FIG. 27B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 28A includes a central display device 1116, a player tracking display 1140, a credit display 1120, and a bet display 1122. The example EGM illustrated in FIGS. 28B, 28C, and 28D includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 28A, 28B, 28C, and 28D each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 28A, 28B, 28C, and 28D each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 28A, 28B, 28C, and 28D, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 28A, 28B, 28C, and 28D, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 28A and 28B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system server comprising:

a processor; and a memory device storing a plurality of instructions which, when executed by the processor, cause the processor to:

generate a primary game outcome in association with a play of a primary game;

communicate first data that results in a display device that is remote from the gaming system server displaying the primary game outcome;

determine whether the primary game outcome is a winning outcome or a losing outcome;

separate from the generation of the primary game outcome and before the display device displays the primary game outcome, randomly determine two or more of a plurality of elements, each element associated with one of multiple different characteristics, in association with a play of a secondary game and communicate second data that results in the display device displaying the two or more randomly-determined elements;

before the display device displays the primary game outcome, determine whether a designated relationship exists between the two or more randomly determined elements, wherein the designated relationship exists if the two or more randomly determined elements are each associated with a same one of the characteristics;

responsive to determining that the designated relationship does not exist between the two or more randomly determined elements and that the primary game outcome is the winning outcome, determine a primary game award based on the primary game outcome and communicate third data that results in the display device displaying the primary game award;

responsive to determining that the designated relationship exists between the two or more randomly determined elements and that the primary game outcome is the winning outcome, determine a modifier and determine the primary game award based on the primary game outcome and the modifier and communicate fourth data that results in the display device displaying the primary game award; and responsive to determining that the designated relationship exists between the two or more randomly determined elements and that the primary game outcome is the losing outcome, not determine any primary game award based on the existence of the designated relationship.

2. The gaming system server of claim 1, wherein the secondary game is associated with a plurality of wheel portions, each of the wheel portions including a plurality of the elements.

3. The gaming system server of claim 2, wherein the plurality of instructions, when executed by the processor, cause the processor to randomly determine the two or more of the plurality of elements by, for each of the wheel portions, randomly determining one of the elements of said wheel portion.

4. The gaming system server of claim 3, wherein the designated relationship exists between the two or more randomly determined elements if the two or more randomly determined elements of the wheel portions are each associated with a same one of the characteristics.

5. The gaming system server of claim 1, wherein the secondary game is associated with a wheel, the wheel includes a plurality of sections, each of the sections is associated with one of the elements, and the plurality of instructions, when executed by the processor, cause the processor to randomly determine the two or more of the plurality of elements by selecting at least two of the sections of the wheel, each of the sections of the wheel being selectable more than once.

6. The gaming system server of claim 5, wherein each selected section of the wheel is selected by a separate indicator, each indicator being one of: a pointer, and a lighted border.

7. The gaming system server of claim 1, wherein the plurality of instructions, when executed by the processor, cause the processor to randomly determine the two or more of the plurality of elements by randomly generating one of the plurality of elements at a first point in time prior to a first event in the primary game and by randomly generating another one of the plurality of elements at a second subsequent point in time after the first event.

8. The gaming system server of claim 7, wherein the primary game is a draw poker game and the first event is a replacement of each of any cards discarded from an initial player hand with a replacement card.

9. The gaming system server of claim 1, wherein the plurality of instructions, when executed by the processor, cause the processor to:

responsive to determining that a first designated relationship exists between the two or more randomly determined elements and that the primary game outcome is the winning outcome, determine a first modifier; and responsive to determining that a second designated relationship exists between the two or more randomly determined elements and that the primary game outcome is the winning outcome, determine a second modifier, the first designated relationship and the second designated relationship being different and the first modifier and the second modifier being different.

10. The gaming system server of claim 1, wherein the display device is part of a mobile device.

11. A method of operating a gaming system server, said method comprising:

generating, by a processor of the gaming system server, a primary game outcome in association with a play of a primary game;

communicating first data that results in a display device that is remote from the gaming system server displaying the primary game outcome;

determining, by the processor, whether the primary game outcome is a winning outcome or a losing outcome;

separate from the generation of the primary game outcome and before the display device displays the generated primary game outcome, randomly determining, by the processor, two or more of a plurality of elements, each element associated with one of multiple different characteristics, in association with a play of a secondary game and communicating second data that results in the display device displaying the two or more randomly-determined elements;

before the display device displays the generated primary game outcome, determining, by the processor, whether a designated relationship exists between the two or more randomly determined elements, wherein the designated relationship exists if the two or more randomly determined elements are each associated with a same one of the characteristics;

responsive to determining that the designated relationship does not exist between the two or more randomly determined elements and that the primary game outcome is the winning outcome, determining, by the processor, a primary game award based on the primary game outcome and communicating third data that results in the display device displaying the primary game award;

responsive to determining that the designated relationship exists between the two or more randomly determined elements and that the primary game outcome is the winning outcome, determining, by the processor, a modifier and determining, by the processor, the primary game award based on the primary game outcome and the modifier and communicating fourth data that results in the display device displaying the primary game award; and responsive to determining that the designated relationship exists between the two or more randomly determined elements and that the primary game outcome is the losing outcome, not determining, by the processor, any primary game award based on the existence of the designated relationship.

12. The method of claim 11, wherein the secondary game is associated with a plurality of wheel portions, each of the wheel portions including a plurality of the elements.

13. The method of claim 12, which includes randomly determining, by the processor, the two or more of the plurality of elements by, for each of the wheel portions, randomly determining one of the elements of said wheel portion.

14. The method of claim 13, wherein the designated relationship exists between the two or more randomly determined elements if the two or more randomly determined elements of the wheel portions are each associated with a same one of the characteristics.

15. The method of claim 11, wherein the secondary game is associated with a wheel, the wheel includes a plurality of sections, and each of the sections is associated with one of the elements, and which includes randomly determining, by the processor, the two or more of the plurality of elements by selecting at least two of the sections of the wheel, each of the sections of the wheel being selectable more than once.

16. The method of claim 15, wherein each selected section of the wheel is selected by a separate indicator, each indicator being one of: a pointer, and a lighted border.

17. The method of claim 11, which includes randomly determining, by the processor, the two or more of the plurality of elements by randomly generating one of the plurality of elements at a first point in time prior to a first event in the primary game and by randomly generating another one of the plurality of elements at a second subsequent point in time after the first event.

18. The method of claim 17, wherein the primary game is a draw poker game and the first event is a replacement of each of any cards discarded from an initial player hand with a replacement card.

19. The method of claim 11, which comprises:

responsive to determining that a first designated relationship exists between the two or more randomly determined elements and that the primary game outcome is the winning outcome, determining, by the processor, a first modifier; and responsive to determining that a second designated relationship exists between the two or more randomly determined elements and that the primary game outcome is the winning outcome, determining, by the processor, a second modifier, the first designated relationship and the second designated relationship being different and the first modifier and the second modifier being different.

* * * * *